US008100196B2

(12) United States Patent
Pastusek et al.

(10) Patent No.: US 8,100,196 B2
(45) Date of Patent: Jan. 24, 2012

(54) METHOD AND APPARATUS FOR COLLECTING DRILL BIT PERFORMANCE DATA

(75) Inventors: Paul E. Pastusek, The Woodlands, TX (US); Eric C. Sullivan, Houston, TX (US); Daryl L. Pritchard, Shenandoah, TX (US); Keith Glasgow, Willis, TX (US); Tu Tien Trinh, Houston, TX (US); Paul J. Lutes, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 510 days.

(21) Appl. No.: 12/367,433

(22) Filed: Feb. 6, 2009

(65) Prior Publication Data

US 2009/0194332 A1 Aug. 6, 2009

Related U.S. Application Data

(63) Continuation-in-part of application No. 11/708,147, filed on Feb. 16, 2007, now Pat. No. 7,849,934.

(51) Int. Cl.
*E21B 47/01* (2006.01)

(52) U.S. Cl. ..... 175/40; 73/152.59

(58) Field of Classification Search ..... 175/45, 175/50, 40, 327; 73/152.48, 152.59, 152.45; 704/200.1, 201
See application file for complete search history.

(56) References Cited

U.S. PATENT DOCUMENTS

| | | | |
|---|---|---|---|
| 2,507,351 | A | 5/1950 | Scherbatskoy |
| 4,884,071 | A | 11/1989 | Howard |
| 4,958,517 | A | 9/1990 | Maron |
| 5,012,412 | A | 4/1991 | Helm |
| 5,129,471 | A | 7/1992 | Maurstad et al. |
| 5,160,925 | A | 11/1992 | Dailey et al. |
| 5,415,030 | A | 5/1995 | Jogi et al. |
| 5,493,288 | A | 2/1996 | Henneuse |
| 5,553,678 | A | 9/1996 | Barr et al. |
| 5,720,355 | A | 2/1998 | Lamine et al. |
| 5,813,480 | A | 9/1998 | Zaleski, Jr. et al. |
| 5,842,149 | A | 11/1998 | Harrell et al. |

(Continued)

FOREIGN PATENT DOCUMENTS

GB 2395971 B1 9/2004

OTHER PUBLICATIONS

Ichida et al., Curve Fitting by a Piecewise Cubic Polynomial, Computing, 1976, vol. 16, No. 4, pp. 329-338.

(Continued)

*Primary Examiner* — Daniel P Stephenson
(74) *Attorney, Agent, or Firm* — TraskBritt

(57) ABSTRACT

Drill bits and methods for sampling sensor data associated with a state of a drill bit are disclosed. A drill bit for drilling a subterranean formation comprises a bit configured for receiving a data analysis module. The data analysis module comprises at least one sensor, a memory, and a processor. The processor is configured for executing computer instructions to filter information derived from sensor data in the drill bit to develop a piecewise polynomial curve of the sensor data. Filtering information derived from the sensor data comprises approximating a first derivative of a sensor data waveform, calculating a plurality of zeros for the first derivative of the sensor data waveform, and fitting a cubic polynomial between adjacent zeros calculated from the first derivative of the sensor data waveform resulting in a piecewise cubic polynomial.

29 Claims, 30 Drawing Sheets

U.S. PATENT DOCUMENTS

| | | | |
|---|---|---|---|
| 5,864,058 | A | 1/1999 | Chen |
| 6,021,377 | A | 2/2000 | Dubinsky et al. |
| 6,057,784 | A | 5/2000 | Schaaf et al. |
| 6,101,462 | A | 8/2000 | King |
| 6,175,818 | B1 | 1/2001 | King |
| 6,176,323 | B1 | 1/2001 | Weirich et al. |
| 6,206,108 | B1 | 3/2001 | MacDonald et al. |
| 6,230,822 | B1 | 5/2001 | Sullivan et al. |
| 6,233,524 | B1 | 5/2001 | Harrell et al. |
| 6,419,032 | B1 | 7/2002 | Sullivan et al. |
| 6,427,783 | B2 | 8/2002 | Krueger et al. |
| 6,540,033 | B1 | 4/2003 | Sullivan et al. |
| 6,543,312 | B2 | 4/2003 | Sullivan et al. |
| 6,571,886 | B1 | 6/2003 | Sullivan et al. |
| 6,626,251 | B1 | 9/2003 | Sullivan et al. |
| 6,648,082 | B2 | 11/2003 | Schultz et al. |
| 6,651,496 | B2 | 11/2003 | Van Steenwyk et al. |
| 6,668,465 | B2 | 12/2003 | Noureldin et al. |
| 6,672,409 | B1 | 1/2004 | Dock et al. |
| 6,681,633 | B2 | 1/2004 | Schultz et al. |
| 6,691,802 | B2 | 2/2004 | Schultz et al. |
| 6,691,804 | B2 | 2/2004 | Harrison |
| 6,698,536 | B2 | 3/2004 | Moran et al. |
| 6,712,160 | B1 | 3/2004 | Schultz et al. |
| 6,722,450 | B2 | 4/2004 | Schultz et al. |
| 6,742,604 | B2 | 6/2004 | Brazil et al. |
| 6,748,354 | B1 | 6/2004 | King |
| 6,769,497 | B2 | 8/2004 | Dubinsky et al. |
| 6,816,788 | B2 | 11/2004 | Van Steenwyk et al. |
| 6,817,425 | B2 | 11/2004 | Schultz et al. |
| 6,820,702 | B2 | 11/2004 | Niedermayr et al. |
| 6,837,314 | B2 | 1/2005 | Krueger et al. |
| 6,892,812 | B2 | 5/2005 | Niedermayr et al. |
| 6,896,055 | B2 | 5/2005 | Koithan |
| 7,017,662 | B2 | 3/2006 | Schultz et al. |
| 7,066,280 | B2 | 6/2006 | Sullivan et al. |
| 7,080,460 | B2 | 7/2006 | Illfelder |
| 7,143,521 | B2 | 12/2006 | Haugland |
| 7,168,506 | B2 | 1/2007 | Boucher et al. |
| 7,260,477 | B2 | 8/2007 | Haugland |
| 2003/0130846 | A1 | 7/2003 | King |
| 2004/0050590 | A1 | 3/2004 | Pirovolou et al. |
| 2004/0112640 | A1 | 6/2004 | Hay et al. |
| 2004/0124012 | A1 | 7/2004 | Dunlop et al. |
| 2004/0149004 | A1 | 8/2004 | Wu |
| 2004/0168827 | A1 | 9/2004 | Jeffryes |
| 2006/0006000 | A1 | 1/2006 | Weston et al. |
| 2006/0260843 | A1 | 11/2006 | Cobern |
| 2006/0272859 | A1 | 12/2006 | Pastusek et al. |
| 2007/0017705 | A1 | 1/2007 | Lasater |
| 2007/0272442 | A1 | 11/2007 | Pastusek et al. |

OTHER PUBLICATIONS

International Search Report for International Application No. PCT/US2010/023300 dated Nov. 29, 2010, 3 pages.

International Written Opinion for International Application No. PCT/US2010/023300 dated Nov. 29, 2010, 4 pages.

Carcione, Jose M., et al., "A Telegrapher Equation for Electric Telemetering in Drill Strings," IEEE Transactions on Geoscience and Remote Sensing, vol. 40, No. 5, May 2002, pp. 1047-1053.

Dashevskiy, D., et al., "Application of Neural Networks for Predictive Control in Drilling Dynamics," SPE 56442, © 1999, Society of Petroleum Engineers Inc.

Finger, J.T., et al., "Development of a System for Diagnostic-While-Drilling (DWD)," SPE/IADC 79884, SPE/IADC Drilling Conference, Amsterdam, The Netherlands, Feb. 19-21, 2003.

Goswami, Jaideva C., et al., "A Robust Technique for Well-Log Data Inversion," IEEE Transactions on Antennas and Propagation, vol. 52, No. 3, Mar. 2004, pp. 717-724.

Hoefel, Albert, et al., "Subsurface Telemetry in Conductive Medium for Remote Sensors," IEEE, (0/7803-7846-6/03), 2003, pp. 227-230.

Leseultre, A., et al., "An Instrumented Bit: A necessary step to the intelligent BHA," IADC/SPE 39341, © 1998, IADC/SPE Drilling Conference.

Ramamurthi, K., et al., "Real Time Expert System for Predictive Diagnostics and Control of Drilling Operation," IEEE (CH2842-3/90/0000/0062), 1990, pp. 62-69.

Schultz, Roger L., et al., "Oilwell Drillbit Failure Detection Using Remote Acoustic Sensing," Proceedings of the American Control Conference, Anchorage, AK, May 8-10, 2002, pp. 2603-2608.

Sinanovic, Sinan, et al., "Data Communication Along the Drill String Using Acoustic Waves," IEEE (0-7803-8484-9/04), 2004, pp. IV-909 through IV-912.

Trofimenkoff, F.N., et al., "Characterization of EM Downhole-to-Surface Communication Links," IEEE Transactions on Geoscience and Remote Sensing, vol. 38, No. 6, Nov. 2000, pp. 2539-2548.

International Search Report for International Counterpart Application No. PCT/US2006/022029, dated Oct. 25, 2006 (5 pages).

| | S=0 | S=1 | S=2 | S=3 | S=4 | S=5 |
|---|---|---|---|---|---|---|
| D = 1 | 1 | | | | | |
| D = 2 | 2 | | | | | |
| D = 3 | 3 | | | | | |
| D = 4 | 4 | 4 | | | | |
| D = 5 | 5 | 5 | | | | |
| D = 6 | 6 | 6 | 6 | | | |
| D = 7 | 6 | 6 | 6 | | | |
| D = 8 | 7 | 8 | 8 | 8 | | |
| D = 9 | 7 | 8 | 8 | 8 | | |
| D = 10 | 7 | 8 | 8 | 8 | 8 | |
| D = 11 | 9 | 10 | 10 | 10 | 10 | 10 |
| D = 12 | 9 | 10 | 10 | 10 | 10 | 10 |
| D = 13 | 9 | 10 | 10 | 10 | 10 | 10 |
| D = 14 | 11 | 12 | 13 | 13 | 13 | 13 |
| D = 15 | 11 | 12 | 13 | 13 | 13 | 13 |
| D = 16 | 11 | 12 | 13 | 13 | 13 | 13 |
| D = 17 | 11 | 12 | 13 | 13 | 13 | 13 |
| D = 18 | 11 | 12 | 13 | 13 | 13 | 13 |
| D = 19 | 14 | 15 | 16 | 17 | 17 | 17 |
| D = 20 | 14 | 15 | 16 | 17 | 17 | 17 |
| D = 21 | 14 | 15 | 16 | 17 | 17 | 17 |
| D = 22 | 14 | 15 | 16 | 17 | 17 | 17 |
| D = 23 | 14 | 15 | 16 | 17 | 17 | 17 |
| D = 24 | 18 | 19 | 20 | 21 | 22 | 22 |
| D = 25 | 18 | 19 | 20 | 21 | 22 | 22 |
| D = 26 | 18 | 19 | 20 | 21 | 22 | 22 |
| D = 27 | 18 | 19 | 20 | 21 | 22 | 22 |
| D = 28 | 18 | 19 | 20 | 21 | 22 | 22 |
| D = 29 | 18 | 19 | 20 | 21 | 22 | 22 |
| D = 30 | 18 | 19 | 20 | 21 | 22 | 22 |
| D = 31 | 23 | 24 | 25 | 26 | 27 | 28 |
| D = 32 | 23 | 24 | 25 | 26 | 27 | 28 |
| D = 33 | 23 | 24 | 25 | 26 | 27 | 28 |
| D = 34 | 23 | 24 | 25 | 26 | 27 | 28 |
| D = 35 | 23 | 24 | 25 | 26 | 27 | 28 |
| D =36 | 23 | 24 | 25 | 26 | 27 | 28 |
| D = 37 | 23 | 24 | 25 | 26 | 27 | 28 |

*FIG. 14*

METHOD AND APPARATUS FOR COLLECTING DRILL BIT PERFORMANCE DATA

RELATED APPLICATIONS

This application is a continuation-in-part of U.S. patent application Ser. No. 11/708,147, entitled METHOD AND APPARATUS FOR COLLECTING DRILL BIT PERFORMANCE DATA, filed Feb. 16, 2007, now U.S. Pat. No. 7,849,934, issued Dec. 14, 2010, which claims the benefit of U.S. patent application Ser. No. 11/146,934, entitled METHOD AND APPARATUS FOR COLLECTING DRILL BIT PERFORMANCE DATA, filed Jun. 7, 2005, now. U.S. Pat. No. 7,604,072, issued Oct. 20, 2009. The disclosure of each of the foregoing applications is hereby incorporated by reference.

FIELD OF THE INVENTION

The present invention relates generally to drill bits for drilling subterranean formations and more particularly to methods and apparatuses for monitoring operating parameters of drill bits during drilling operations.

BACKGROUND OF THE INVENTION

The oil and gas industry expends sizable sums to design cutting tools, such as downhole drill bits including roller cone rock bits and fixed cutter bits, which have relatively long service lives, with relatively infrequent failure. In particular, considerable sums are expended to design and manufacture roller cone rock bits and fixed cutter bits in a manner that minimizes the opportunity for catastrophic drill bit failure during drilling operations. The loss of a roller cone or a polycrystalline diamond compact (PDC) from a fixed cutter bit during drilling operations can impede the drilling operations and, at worst, necessitate rather expensive fishing operations. If the fishing operations fail, sidetrack-drilling operations must be performed in order to drill around the portion of the wellbore that includes the lost roller cones or PDC cutters. Typically, during drilling operations, bits are pulled and replaced with new bits even though significant service could be obtained from the replaced bit. These premature replacements of downhole drill bits are expensive, since each trip out of the well prolongs the overall drilling activity, and consumes considerable manpower, but are nevertheless done in order to avoid the far more disruptive and expensive process of, at best, pulling the drill string and replacing the bit or fishing and sidetrack drilling operations necessary if one or more cones or compacts are lost due to bit failure.

With the ever-increasing need for downhole drilling system dynamic data, a number of "subs" (i.e., a sub-assembly incorporated into the drill string above the drill bit and used to collect data relating to drilling parameters) have been designed and installed in drill strings. Unfortunately, these subs cannot provide actual data for what is happening operationally at the bit due to their physical placement above the bit itself.

Data acquisition is conventionally accomplished by mounting a sub in the Bottom-Hole Assembly (BHA), which may be several feet to tens of feet away from the bit. Data gathered from a sub this far away from the bit may not accurately reflect what is happening directly at the bit while drilling occurs. Often, this lack of data leads to conjecture as to what may have caused a bit to fail or why a bit performed so well, with no directly relevant facts or data to correlate to the performance of the bit.

Recently, data acquisition systems have been proposed to install in the drill bit itself. However, data gathering, storing, and reporting from these systems has been limited. In addition, conventional data gathering in drill bits has not had the capability to adapt to drilling events that may be of interest in a manner allowing more detailed data gathering and analysis when these events occur.

There is a need for a drill bit equipped to gather and store long-term data that is related to performance and condition of the drill bit. Such a drill bit may extend useful bit life enabling re-use of a bit in multiple drilling operations and developing drill bit performance data on existing drill bits, which also may be used for developing future improvements to drill bits.

BRIEF SUMMARY OF THE INVENTION

In one embodiment of the present invention, a drill bit for drilling a subterranean formation comprises a chamber formed therein, a first set of accelerometers, and a second set of accelerometers. The bit carries at least one cutting element (also referred to as a "cutter") and is adapted for coupling to a drill string. The chamber is configured for maintaining a pressure substantially near a surface atmospheric pressure while drilling the subterranean formation. The first set of accelerometers is disposed at a first location in the bit and comprises a first radial accelerometer and a second radial accelerometer. The second set of accelerometers is disposed at a second location in the bit and comprises a third radial accelerometer and a fourth radial accelerometer. Finally, the first, second, third, and fourth radial accelerometers are configured for sensing radial acceleration effects on the drill bit.

Another embodiment of the invention comprises an apparatus for drilling a subterranean formation including a drill bit and a data analysis module disposed in the drill bit. The drill bit carries at least one cutting element and is adapted for coupling to a drill string. The data analysis module comprises a plurality of sensors, a memory, and a processor. The plurality of sensors are configured for sensing at least one physical parameter, wherein the plurality of sensors comprises at least one magnetometer configured for sensing magnetic fields acting on the drill bit. The memory is configured for storing information comprising computer instructions and sensor data. The processor is configured for executing the computer instructions to collect the sensor data by sampling the plurality of sensors. Furthermore, the computer instructions are configured for recalibrating the at least one magnetometer.

Another embodiment of the invention comprises an apparatus for drilling a subterranean formation including a drill bit and a data analysis module disposed in the drill bit. The drill bit carries at least one cutting element and is adapted for coupling to a drill string. The data analysis module comprises a plurality of sensors, a memory, a processor, and a power source. The plurality of sensors are configured for sensing at least one physical parameter, wherein the plurality of sensors comprises at least one magnetometer configured for sensing magnetic fields acting on the drill bit. The memory is configured for storing information comprising computer instructions and sensor data. The processor is configured for executing the computer instructions to collect the sensor data by sampling the plurality of sensors, wherein the computer instructions are configured for recalibrating the at least one magnetometer. Finally, the power source is configured for supplying a first voltage for the plurality of sensors and supplying a second voltage for the processor.

Another embodiment of the invention includes a method comprising collecting sensor data at a sampling frequency by sampling at least one sensor disposed in a drill bit. In this method, the at least one sensor is responsive to at least one physical parameter associated with a drill bit state. The method further comprises filtering the sensor data in the drill bit to develop a piecewise polynomial curve of the sensor data, wherein filtering comprises approximating a first derivative of a sensor data waveform, calculating a plurality of zeros from the first derivative of the sensor data waveform, and fitting a cubic polynomial between adjacent zeros calculated from the first derivative.

Another embodiment of the invention comprises an apparatus for drilling a subterranean formation including a drill bit and a data analysis module disposed in the drill bit. The drill bit carries at least one cutting element and is adapted for coupling to a drill string. The data analysis module comprises a plurality of sensors, a memory, and a processor. The plurality of sensors is configured for sensing at least one physical parameter. The processor is operably coupled to the memory and is configured for executing the computer instructions. Furthermore, the computer instructions are configured for filtering information derived from the sensor data in the drill bit to develop a piecewise polynomial curve of the sensor data. Filtering comprises approximating a first derivative of a sensor data waveform, calculating a plurality of zeros from the first derivative of the sensor data waveform, and fitting a cubic polynomial between adjacent zeros calculated from the first derivative.

BRIEF DESCRIPTION OF THE SEVERAL VIEWS OF THE DRAWINGS

FIG. 14 illustrates a contemplated TESPAR alphabet for use in encoding possible sampled data in accordance with the invention;

DETAILED DESCRIPTION OF THE INVENTION

The present invention includes a drill bit and an electronics module disposed within the drill bit for analysis of data sampled from physical parameters related to drill bit performance using a variety of adaptive data sampling modes.

Figure 1:
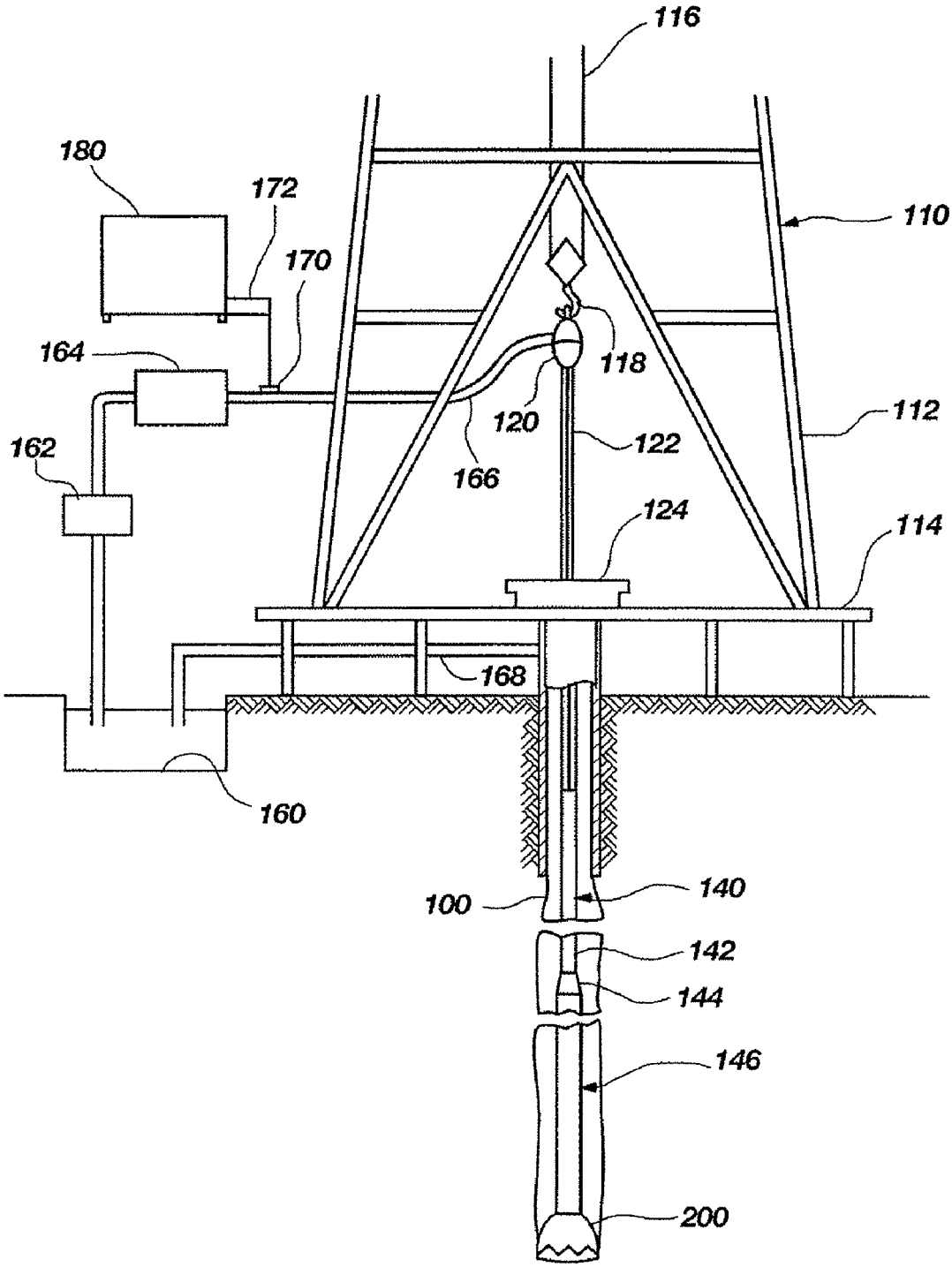
FIG. 1 illustrates a conventional drilling rig for performing drilling operations.

FIG. 1 depicts an example of conventional apparatus for performing subterranean drilling operations. Drilling rig 110 includes a derrick 112, a derrick floor 114, a draw works 116, a hook 118, a swivel 120, a Kelly joint 122, and a rotary table 124. A drill string 140, which includes a drill pipe section 142 and a drill collar section 144, extends downward from the drilling rig 110 into a borehole 100. The drill pipe section 142 may include a number of tubular drill pipe members or strands connected together and the drill collar section 144 may likewise include a plurality of drill collars. In addition, the drill string 140 may include a measurement-while-drilling (MWD) logging subassembly and cooperating mud pulse telemetry data transmission subassembly, which are collectively referred to as an MWD communication system 146, as well as other communication systems known to those of ordinary skill in the art.

During drilling operations, drilling fluid is circulated from a mud pit 160 through a mud pump 162, through a desurger 164, and through a mud supply line 166 into the swivel 120. The drilling mud (also referred to as drilling fluid) flows through the Kelly joint 122 and into an axial central bore in the drill string 140. Eventually, it exits through apertures or nozzles, which are located in a drill bit 200, which is connected to the lowermost portion of the drill string 140 below drill collar section 144. The drilling mud flows back up through an annular space between the outer surface of the drill string 140 and the inner surface of the borehole 100, to be circulated to the surface where it is returned to the mud pit 160 through a mud return line 168.

A shaker screen (not shown) may be used to separate formation cuttings from the drilling mud before it returns to the mud pit 160. The MWD communication system 146 may utilize a mud pulse telemetry technique to communicate data from a downhole location to the surface while drilling operations take place. To receive data at the surface, a mud pulse transducer 170 is provided in communication with the mud supply line 166. This mud pulse transducer 170 generates electrical signals in response to pressure variations of the drilling mud in the mud supply line 166. These electrical signals are transmitted by a surface conductor 172 to a surface electronic processing system 180, which is conventionally a data processing system with a central processing unit for executing program instructions, and for responding to user commands entered through either a keyboard or a graphical pointing device. The mud pulse telemetry system is provided for communicating data to the surface concerning numerous downhole conditions sensed by well logging and measurement systems that are conventionally located within the MWD communication system 146. Mud pulses that define the data propagated to the surface are produced by equipment conventionally located within the MWD communication system 146. Such equipment typically comprises a pressure pulse generator operating under control of electronics contained in an instrument housing to allow drilling mud to vent through an orifice extending through the drill collar wall. Each time the pressure pulse generator causes such venting, a negative pressure pulse is transmitted to be received by the mud pulse transducer 170. An alternative conventional arrangement generates and transmits positive pressure pulses. As is conventional, the circulating drilling mud also may provide a source of energy for a turbine-driven generator subassembly (not shown) which may be located near a bottom-hole assembly (BHA). The turbine-driven generator may generate electrical power for the pressure pulse generator and for various circuits including those circuits that form the operational components of the measurement-while-drilling tools. As an alternative or supplemental source of electrical power, batteries may be provided, particularly as a backup for the turbine-driven generator.

Figure 2:
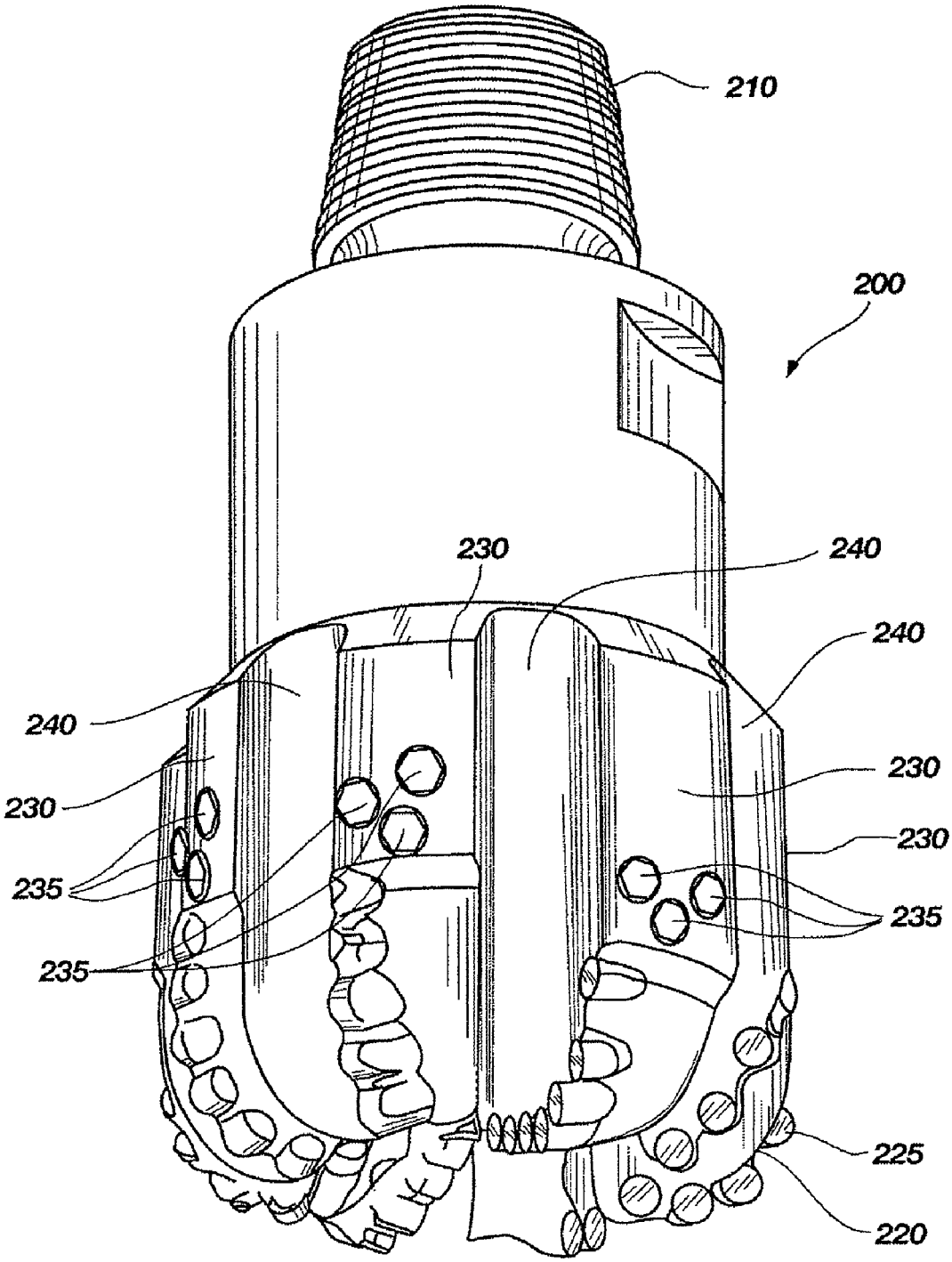
FIG. 2 is a perspective view of a conventional matrix-type rotary drag bit.

FIG. 2 is a perspective view of an example of a drill bit 200 of a fixed-cutter, or so-called "drag" bit, variety. Conventionally, the drill bit 200 includes threads at a shank 210 at the upper extent of the drill bit 200 for connection into the drill string 140 (FIG. 1). At least one blade 220 (a plurality shown) at a generally opposite end from the shank 210 may be provided with a plurality of natural or synthetic diamonds (polycrystalline diamond compact) PDC cutters 225, arranged along the rotationally leading faces of the blades 220 to effect efficient disintegration of formation material as the drill bit 200 is rotated in the borehole 100 (FIG. 1) under applied weight on bit (WOB). A gage pad surface 230 extends upwardly from each of the blades 220, is proximal to, and generally contacts the sidewall of the borehole 100 (FIG. 1) during drilling operation of the drill bit 200. A plurality of channels 240, termed "junkslots," extend between the blades 220 and the gage pad surfaces 230 to provide a clearance area for removal of formation chips formed by the cutters 225.

A plurality of gage inserts 235 is provided on the gage pad surfaces 230 of the drill bit 200. Shear cutting gage inserts 235 on the gage pad surfaces 230 of the drill bit 200 provide the ability to actively shear formation material at the sidewall of the borehole 100 and to provide improved gage-holding ability in earth-boring bits of the fixed cutter variety. The drill bit 200 is illustrated as a PDC (polycrystalline diamond compact) bit, but the gage inserts 235 may be equally useful in other fixed cutter or drag bits that include gage pad surfaces 230 for engagement with the sidewall of the borehole 100 (FIG. 1).

Those of ordinary skill in the art will recognize that the present invention may be embodied in a variety of drill bit types. The present invention possesses utility in the context of a tricone or roller cone rotary drill bit or other subterranean drilling tools as known in the art that may employ nozzles for delivering drilling mud to a cutting structure during use. Accordingly, as used herein, the term "drill bit" includes and encompasses any and all rotary bits, including core bits, rollercone bits, fixed cutter bits; including PDC, natural diamond, thermally stable produced (TSP) synthetic diamond, and diamond impregnated bits without limitation, eccentric bits, bicenter bits, reamers, reamer wings, as well as other earth-boring tools configured for acceptance of an electronics module 290 (FIG. 3A).

Figure 3A:
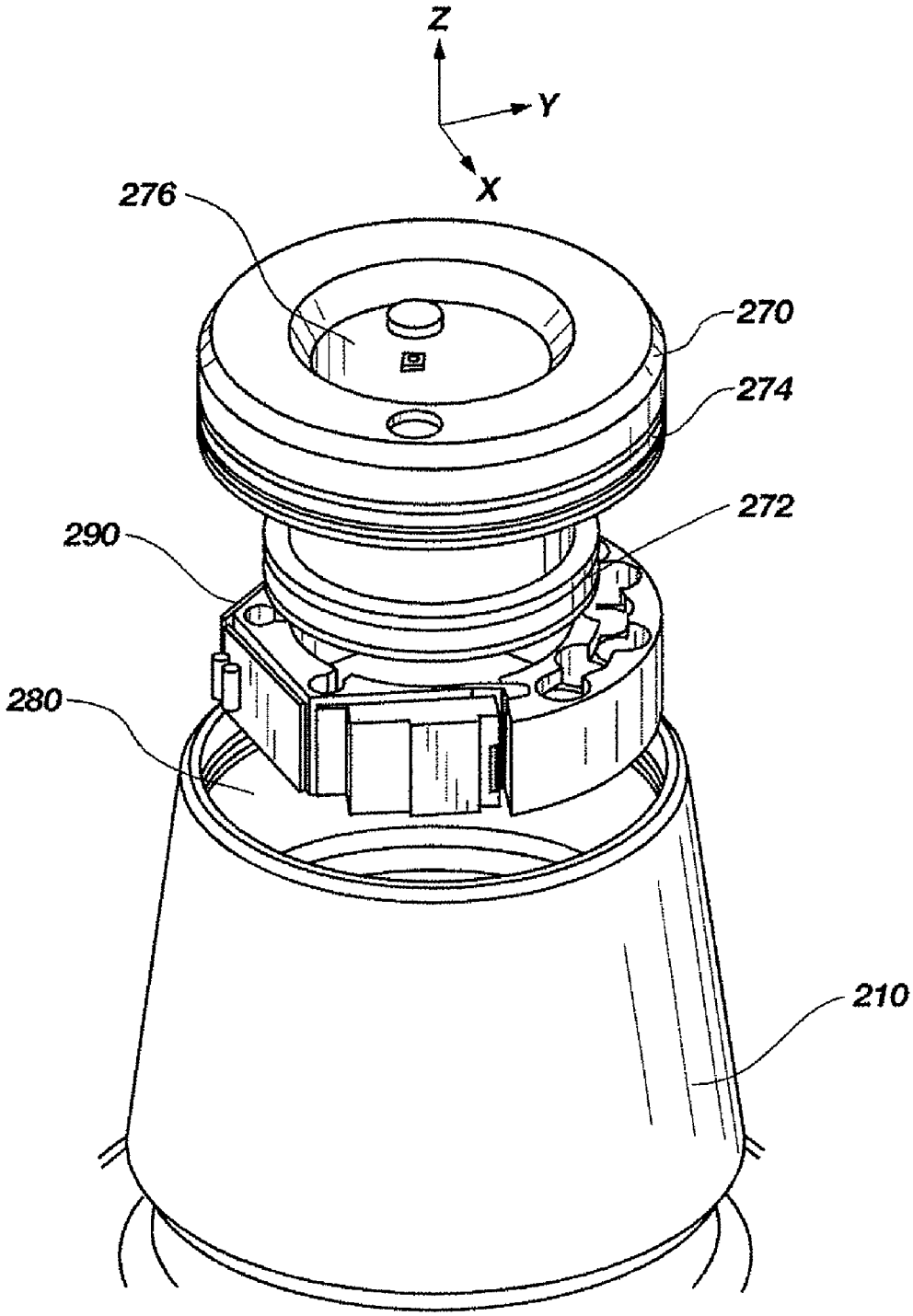
FIG. 3A is a perspective view of a shank, receiving an embodiment of an electronics module with an end-cap.
Figure 3B:
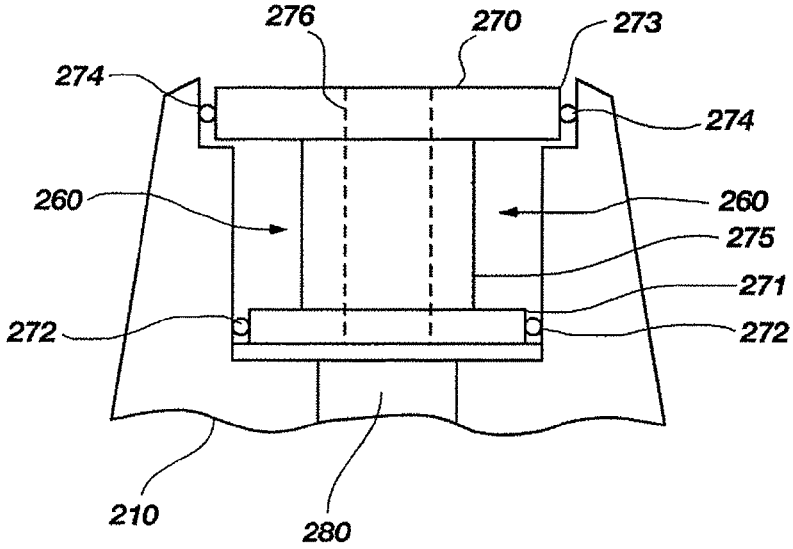
FIG. 3B is a cross-sectional view of a shank and an end-cap.

FIGS. 3A and 3B illustrate an embodiment of a shank 210 secured to a drill bit 200 (not shown), an end-cap 270, and an embodiment of an electronics module 290 (not shown in FIG. 3B). The shank 210 includes a central bore 280 formed through the longitudinal axis of the shank 210. In conventional drill bits 200, this central bore 280 is configured for allowing drilling mud to flow therethrough. In the present invention, at least a portion of the central bore 280 is given a diameter sufficient for accepting the electronics module 290 configured in a substantially annular ring, yet without substantially affecting the structural integrity of the shank 210. Thus, the electronics module 290 may be placed down in the central bore 280, about the end-cap 270, which extends through the inside diameter of the annular ring of the electronics module 290 to create a fluid-tight annular chamber 260 (FIG. 3B) with the wall of central bore 280 and seal the electronics module 290 in place within the shank 210.

The end-cap 270 includes a cap bore 276 formed therethrough, such that the drilling mud may flow through the end-cap 270, through the central bore 280 of the shank 210 to the other side of the shank 210, and then into the body of drill bit 200. In addition, the end-cap 270 includes a first flange 271 including a first sealing ring 272, near the lower end of the end-cap 270, and a second flange 273 including a second sealing ring 274, near the upper end of the end-cap 270.

Figure 4:
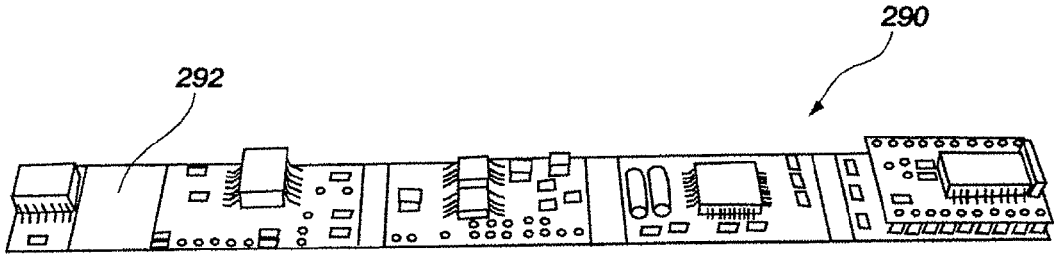
FIG. 4 is a drawing of an embodiment of an electronics module configured as a flex-circuit board enabling formation into an annular ring suitable for disposition in the shank of FIGS. 3A and 3B.

FIG. 3B is a cross-sectional view of the end-cap 270 disposed in the shank without the electronics module 290 (FIG. 4), illustrating the annular chamber 260 formed between the first flange 271, the second flange 273, the end-cap body 275, and the walls of the central bore 280. The first sealing ring 272 and the second sealing ring 274 form a protective, fluid-tight seal between the end-cap 270 and the wall of the central bore 280 to protect the electronics module 290 (FIG. 4) from adverse environmental conditions. The protective seal formed by the first sealing ring 272 and the second sealing ring 274 may also be configured to maintain the annular chamber 260 at approximately atmospheric pressure.

In the embodiment shown in FIGS. 3A and 3B, the first sealing ring 272 and the second sealing ring 274 are formed of material suitable for high-pressure, high-temperature environment, such as, for example, a Hydrogenated Nitrile Butadiene Rubber (HNBR) O-ring in combination with a PEEK back-up ring. In addition, the end-cap 270 may be secured to the shank 210 with a number of connection mechanisms such as, for example, a secure press-fit using sealing rings 272 and 274, a threaded connection, an epoxy connection, a shape-memory retainer, welded, and brazed. It will be recognized by those of ordinary skill in the art that the end-cap 270 may be held in place quite firmly by a relatively simple connection mechanism due to differential pressure and downward mud flow during drilling operations.

An electronics module 290 configured as shown in the embodiment of FIG. 3A may be configured as a flex-circuit board, enabling the formation of the electronics module 290 into the annular ring suitable for disposition about the end-cap 270 and into the central bore 280. This flex-circuit board embodiment of the electronics module 290 is shown in a flat uncurled configuration in FIG. 4. The flex-circuit board 292 includes a high-strength reinforced backbone (not shown) to provide acceptable transmissibility of acceleration effects to sensors such as accelerometers. In addition, other areas of the flex-circuit board 292 bearing non-sensor electronic components may be attached to the end-cap 270 in a manner suitable for at least partially attenuating the acceleration effects experienced by the drill bit 200 during drilling operations using a material such as a visco-elastic adhesive.

Figure 5A:
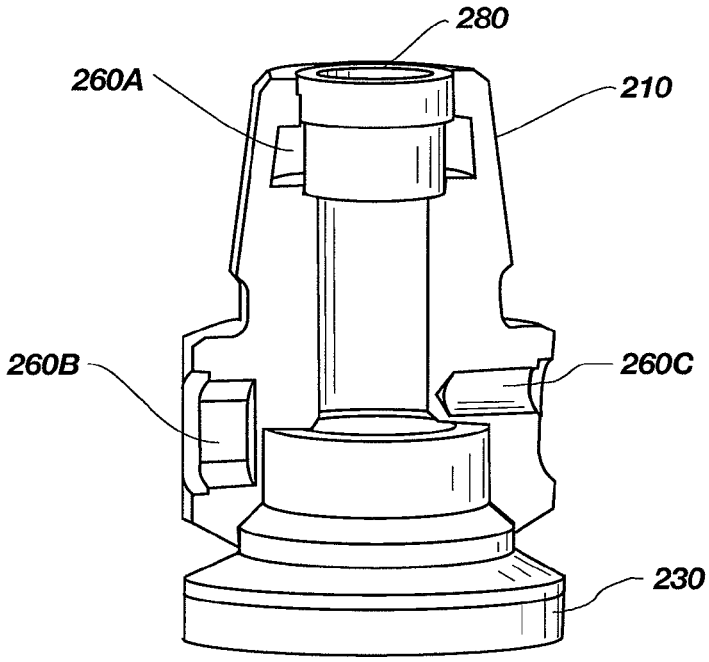
FIGS. 5A-5E are perspective views of a drill bit illustrating example locations in the drill bit wherein an electronics module, sensors, or combinations thereof may be located.

FIGS. 5A-5E are perspective views of portions of a drill bit illustrating examples of locations in the drill bit wherein an electronics module 290 (FIG. 4), sensors 340 and 370 (FIG. 6), or combinations thereof may be located. FIG. 5A illustrates the shank 210 of FIG. 3A secured to a bit body 230. In addition, the shank 210 includes an annular race 260A formed in the central bore 280. This annular race 260A may allow expansion of the electronics module into the annular race 260A as the end-cap 270 is disposed into position.

FIG. 5A also illustrates two other alternate location for the electronics module 290, sensors 340 and 370, or combinations thereof. An oval cutout 260B, located behind the oval depression (may also be referred to as a torque slot) used for stamping the bit with a serial number may be milled out to accept the electronics. This area could then be capped and sealed to protect the electronics. Alternatively, a round cutout 260C located in the oval depression used for stamping the bit may be milled out to accept the electronics, then may be capped and sealed to protect the electronics.

Figure 5B:
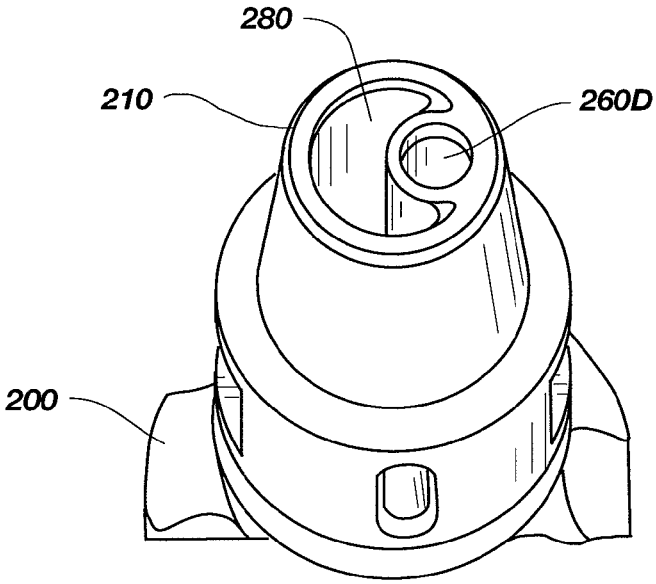

FIG. 5B illustrates an alternative configuration of the shank 210. A circular depression 260D may be formed in the shank 210 and the central bore 280 formed around the circular depression 260D, allowing transmission of the drilling mud. The circular depression 260D may be capped and sealed to protect the electronics within the circular depression 260D.

Figure 5C:
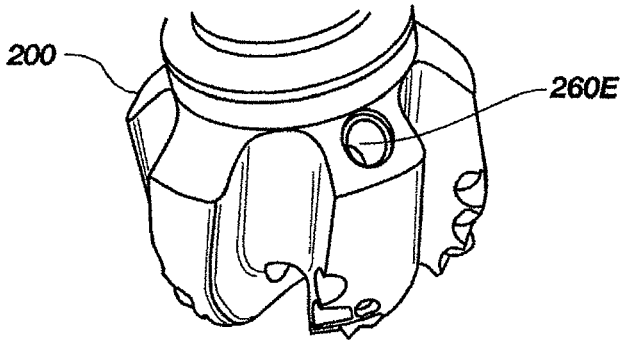
Figure 5D:
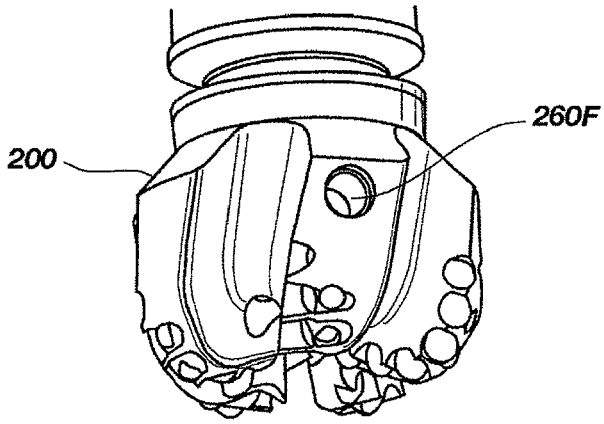
Figure 5E:
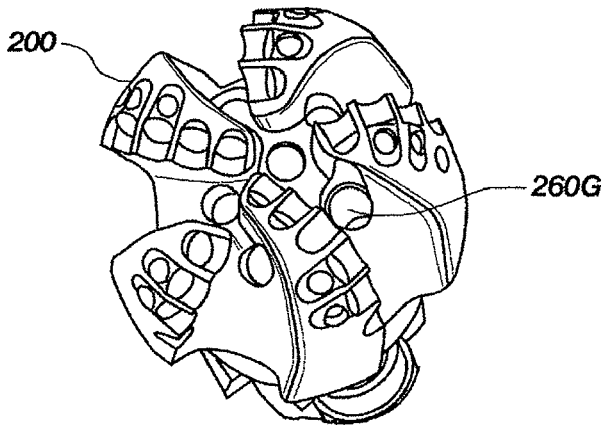

FIGS. 5C-5E illustrate circular depressions (260E, 260F, 260G) formed in locations on the drill bit 200. These locations offer a reasonable amount of room for electronic components while still maintaining acceptable structural strength in the blade.

An electronics module may be configured to perform a variety of functions. One embodiment of an electronics module 290 (FIG. 4) may be configured as a data analysis module, which is configured for sampling data in different sampling modes, sampling data at different sampling frequencies, and analyzing data.

Figure 6:
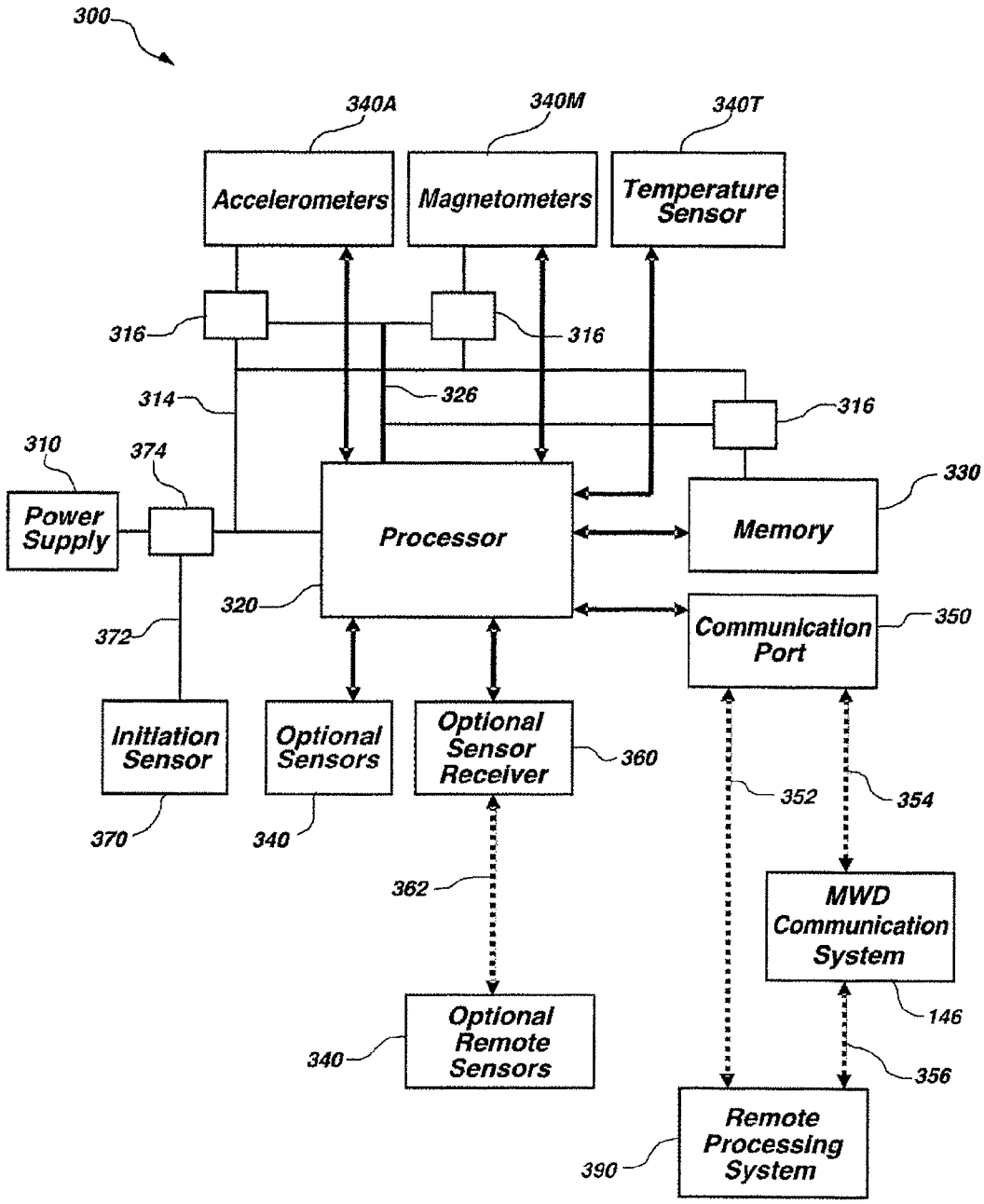
FIG. 6 is a block diagram of an embodiment of a data analysis module according to the present invention.

An embodiment of a data analysis module 300 is illustrated in FIG. 6. The data analysis module 300 includes a power supply 310, a processor 320, a memory 330, and at least one sensor 340 configured for measuring a plurality of physical parameter related to a drill bit state, which may include drill bit condition, drilling operation conditions, and environmental conditions proximate the drill bit. In the embodiment of FIG. 6, the sensors 340 include a plurality of accelerometers 340A, a plurality of magnetometers 340M, and at least one temperature sensor 340T.

The plurality of accelerometers 340A may include three accelerometers 340A configured in a Cartesian coordinate arrangement. Similarly, the plurality of magnetometers 340M may include three magnetometers 340M configured in a Cartesian coordinate arrangement. While any coordinate system may be defined within the scope of the present invention, one example of a Cartesian coordinate system, shown in FIG. 3A, defines a z-axis along the longitudinal axis about which the drill bit 200 (FIG. 2) rotates, an x-axis perpendicular to the z-axis, and a y-axis perpendicular to both the z-axis and the x-axis, to form the three orthogonal axes of a typical Cartesian coordinate system. Because the data analysis module 300 may be used while the drill bit 200 is rotating and with the drill bit 200 in other than vertical orientations, the coordinate system may be considered a rotating Cartesian coordinate system with a varying orientation relative to the fixed surface location of the drilling rig 110 (FIG. 1).

The accelerometers 340A of the FIG. 6 embodiment, when enabled and sampled, provide a measure of acceleration of the drill bit along at least one of the three orthogonal axes. The data analysis module 300 may include additional accelerometers 340A to provide a redundant system, wherein various accelerometers 340A may be selected, or deselected, in response to fault diagnostics performed by the processor 320. Furthermore, additional accelerometers 340A may be used to determine additional information about bit dynamics and assist in distinguishing lateral accelerations from angular accelerations.

Figure 6A:
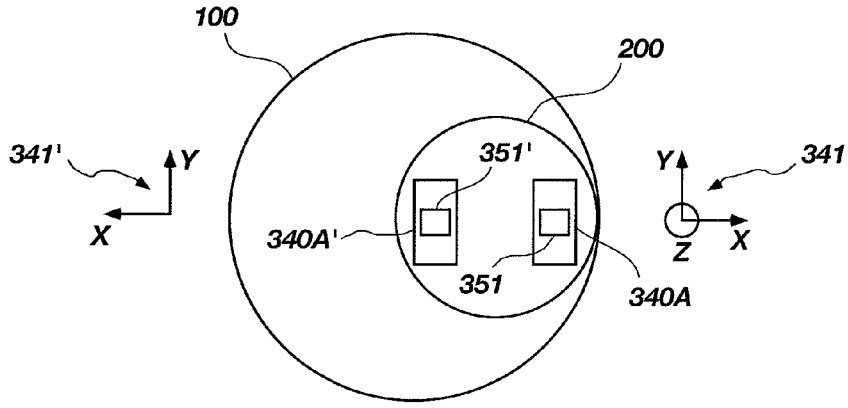
FIG. 6A illustrates placement of multiple accelerometers, which may be used, by way of example, for redundancy, trajectory analysis, and combinations thereof.

FIG. 6A is a top view of a drill bit 200 within a borehole 100. As can be seen, FIG. 6A illustrates the drill bit 200 offset within the borehole 100, which may occur due to bit behavior other than simple rotation around a rotational axis. FIG. 6A also illustrates placement of multiple accelerometers, with a first set of accelerometers 340A positioned at a first location and a second set of accelerometers 340A' positioned at a second location within the drill bit 200. By way of example, the first set of accelerometers 340A includes a first coordinate system 341 with x, y, and z accelerometers, while the second set of accelerometers 340A' includes a second coordinate system 341' with x and y accelerometers. For example only, a y accelerometer may be configured, positioned and oriented to detect and measure a tangential acceleration of drill bit 200, an x accelerometer may be configured, positioned and oriented to detect and measure a radial acceleration of drill bit 200, and a z accelerometer may be configured, positioned and oriented to detect and measure an axial acceleration of drill bit 200. As a non-limiting example, first set of accelerometers 340A and second set of accelerometers 340A' may comprise accelerometers rated for 30 g acceleration. Furthermore, first set of accelerometers 340A and second set of accelerometers 340A' may each include an additional x accelerometer 351 located with the first set of accelerometers 340A and an additional x accelerometer 351' located with the second set of accelerometers 340A'. These additional x accelerometers (351 and 351') may be configured, positioned and oriented to detect and measure lower accelerations in a radial direction relative to the x accelerometers in the first set of accelerometers 340A and the second set of accelerometers 340A'. For a non-limiting example only, x accelerometers 351 and 351' may comprise accelerometers rated for 5 g accelerations. As such, x accelerometers 351 and 351' may provide enhanced granularity and, thus, enhanced precision in revolutions per minute (RPM) calculations.

For example, in high-motion situations, the first set 340A and the second set 340A' of accelerometers provide data over a large range of accelerations (i.e., up to 30 g). In lower motion situations, x accelerometers 351 and 351' provide more precision in measurement of the acceleration at these lower accelerations. As a result, more precise calculations may be performed when deriving dynamic behavior at low accelerations.

Of course, other embodiments may include three coordinates in the second set of accelerometers as well as other configurations and orientations of accelerometers alone or in multiple coordinate sets. With the placement of a second set of accelerometers at a different location on the drill bit, differences between the accelerometer sets may be used to distinguish lateral accelerations from angular accelerations. For example, if the two sets of accelerometers are both placed at the same radius from the rotational center of the drill bit 200 and the drill bit 200 is only rotating about that rotational center, then the two accelerometer sets will experience the same angular rotation. However, the bit may be experiencing more complex behavior, such as, for example, bit whirl, bit wobble, bit walking, and lateral vibration. These behaviors include some type of lateral motion in combination with the angular motion. For example, as illustrated in FIG. 6A, the drill bit 200 may be rotating about its rotational axis and at the same time, walking around the larger circumference of the borehole 100. In these types of motion, the two sets of accelerometers 340A and 340A' disposed at different places will experience different accelerations. With the appropriate signal processing and mathematical analysis, the lateral accelerations and angular accelerations may be more easily determined with the additional accelerometers.

Furthermore, if initial conditions are known or estimated, bit velocity profiles and relative bit trajectories may be inferred by mathematical integration of the accelerometer data using conventional numerical analysis techniques. As is explained more fully below, acceleration data may be analyzed and used to determine adaptive thresholds to trigger specific events within the data analysis module. Furthermore, if the acceleration data is integrated to obtain bit velocity profiles or bit trajectories, these additional data sets may be useful for determining additional adaptive thresholds through direct application of the data set or through additional processing, such as, for example, pattern-recognition analysis. By way of example, and not limitation, an adaptive threshold may be set based on how far off center a bit may traverse before triggering an event of interest within the data analysis module. For example, if the bit trajectory indicates that the bit is offset from the center of the borehole by more than one inch, a different algorithm of data collection from the sensors may be invoked, as is explained more fully below.

The magnetometers 340M of the FIG. 6 embodiment, when enabled and sampled, provide a measure of the orientation of the drill bit 200 along at least one of the three orthogonal axes relative to the earth's magnetic field. The data analysis module 300 may include additional magnetometers 340M to provide a redundant system, wherein various magnetometers 340M may be selected, or deselected, in response to fault diagnostics performed by the processor 320.

Data analysis module 300 may be configured to provide for recalibration of magnetometers 340M during operation. Recalibration of magnetometers 340M may be necessary or desirable to remove magnetic field effects caused by the environment in which the magnetometers 340M reside. For example, measurements taken in a downhole environment may include errors induced by a high magnetic field within the downhole formation. Therefore, it may be advantageous to recalibrate the magnetometers 340M prior to taking new measurements in order to take into account the high magnetic field within the downhole formation. In addition, magnetometers exposed to high magnetic fields may be become less sensitive. A recalibration may be used to increase the sensitivity of the magnetometers relative to the high magnetic field environment.

The temperature sensor 340T may be used to gather data relating to the temperature of the drill bit 200, and the temperature near the accelerometers 340A, magnetometers 340M, and other sensors 340. Temperature data may be useful for calibrating the accelerometers 340A and magnetometers 340M to be more accurate at a variety of temperatures.

Other optional sensors 340 may be included as part of the data analysis module 300. Some non-limiting examples of sensors that may be useful in the present invention are strain sensors at various locations of the drill bit, temperature sensors at various locations of the drill bit, mud (drilling fluid) pressure sensors to measure mud pressure internal to the drill bit, and borehole pressure sensors to measure hydrostatic pressure external to the drill bit. Sensors may also be implemented to detect mud properties, such as, for example, sensors to detect conductivity or impedance to both alternating current and direct current, sensors to detect influx of fluid from the hole when mud flow stops, sensors to detect changes in mud properties, and sensors to characterize mud properties such as synthetic-based mud and water-based mud.

These optional sensors 340 may include sensors 340 that are integrated with and configured as part of the data analysis module 300. These sensors 340 may also include optional remote sensors 340 placed in other areas of the drill bit 200, or above the drill bit 200 in the bottom hole assembly. The optional sensors 340 may communicate using a direct-wired connection 362, or through a wireless connection to an optional sensor receiver 360. The optional sensor receiver 360 is configured to enable wireless remote sensor communication across limited distances in a drilling environment as is known by those of ordinary skill in the art.

One or more of these optional sensors may be used as an initiation sensor 370. The initiation sensor 370 may be configured for detecting at least one initiation parameter, such as, for example, turbidity of the mud, and generating a power enable signal 372 responsive to the at least one initiation parameter. A power gating module 374 coupled between the power supply 310 and the data analysis module 300 may be used to control the application of power to the data analysis module 300 when the power enable signal 372 is asserted. The initiation sensor 370 may have its own independent power source, such as a small battery, for powering the initiation sensor 370 during times when the data analysis module 300 is not powered. As with the other optional sensors 340, some non-limiting examples of parameter sensors that may be used for enabling power to the data analysis module 300 are sensors configured to sample; strain at various locations of the drill bit, temperature at various locations of the drill bit, vibration, acceleration, centripetal acceleration, fluid pressure internal to the drill bit, fluid pressure external to the drill bit, fluid flow in the drill bit, fluid impedance, and fluid turbidity.

By way of example, and not limitation, an initiation sensor 370 may be used to enable power to the data analysis module 300 in response to changes in fluid impedance for fluids such as, for example, air, water, oil, and various mixtures of drilling mud. These fluid property sensors may detect a change in DC resistance between two terminals exposed to the fluid or a change in AC impedance between two terminals exposed to the fluid. In another embodiment, a fluid property sensor may detect a change in capacitance between two terminals in close proximity to, but protected from, the fluid.

For example, water may have a relatively high dielectric constant as compared with typical hydrocarbon-based lubricants. The data analysis module 300, or other suitable electronics, may energize the sensor with alternating current and measure a phase shift therein to determine capacitance, for example, or alternatively may energize the sensor with alternating or direct current and determine a voltage drop to measure impedance.

In addition, at least some of these sensors may be configured to generate any required power for operation such that the independent power source is self-generated in the sensor. By way of example, and not limitation, a vibration sensor may generate sufficient power to sense the vibration and transmit the power enable signal 372 simply from the mechanical vibration.

Figure 6B:
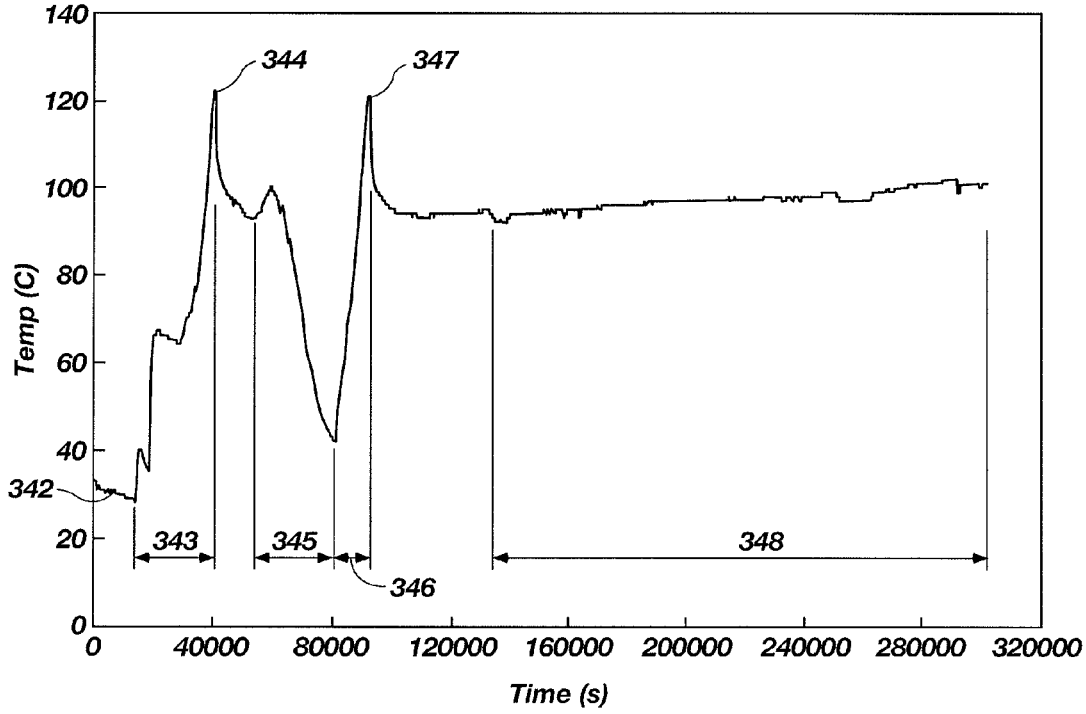
FIG. 6B illustrates an example of data sampled from a temperature sensor.

As another example of an initiation sensor 370 embodiment, FIG. 6B illustrates an example of data sampled from a temperature sensor as the drill bit traverses up and down a borehole. In FIG. 6B, point 342 illustrates the sensed temperature when the drill bit is at the surface. The increasing temperature along duration 343 is indicative of the temperature increase experienced as the drill bit traverses down a previously drilled borehole. At point 344, the mud pumps are turned on and the graph illustrates a corresponding decrease in temperature of the drill bit to about 90 degrees C. Duration 345 illustrates that the mud pumps have been turned off and the drill bit is being partially withdrawn from the borehole. Duration 346 illustrates that the drill bit, after being partially withdrawn, is again traversing down the previously drilled borehole. Point 347 illustrates that the mud pumps are again turned on. Finally, the steadily increasing temperature along duration 348 illustrates normal drilling as the drill bit achieves additional depth.

As can be seen from FIG. 6B, the sensed temperature differential between the surface ambient temperature and the downhole ambient temperature may be used as an initiation point to enable additional sensor data processing, or enable power to additional sensors, such as, for example, via power controllers 316 (FIG. 6). The temperature differential may be programmable for the application for which the bit is intended. For example, surface temperature during transport may range from about 70 degrees F. to 105 degrees F., and the downhole temperature at the point where additional features would be turned on may be about 175 degrees F. The differential may be about 70 degrees F. and would be wide enough to ensure against false starts. When the bit enters the 175 degree zone in the borehole the module may turn on automatically and begin gathering data. The activation can be triggered by absolute temperature or by differential temperature change. After the module is triggered it may be locked on and continue to run for the duration of the time in the borehole, or if a large enough temperature drop is detected, the additional features may be turned off. In the example discussed, and referring to FIG. 6, the temperature sensor 340T is configured to be sampled by the processor 320 running in a low-power configuration and the processor 320 may perform the decisions for enabling additional features based on the sensed temperature. Of course as discussed earlier, the temperature sensor may be an initiation sensor 370 (FIG. 6) with its own power source, or a sensor that does not require power. In this stand-alone configuration, the initiation sensor 370 (FIG. 6) may be configured to enable power to the entire data analysis module 300 via the power gating module 374.

Figure 6C:
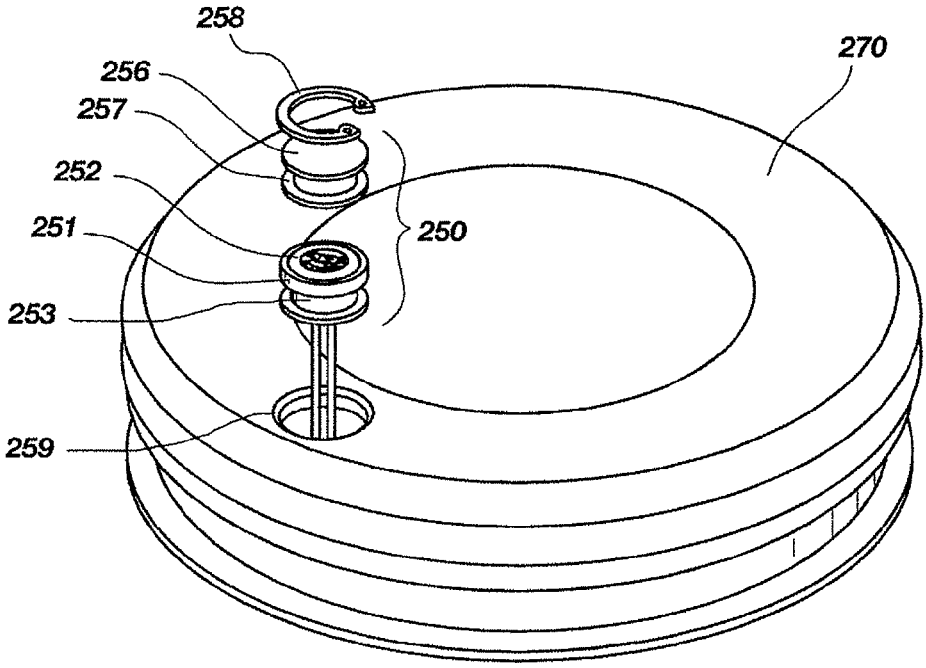
FIG. 6C is a perspective view showing an embodiment of a placement of a pressure activated switch in an end cap of the drill bit.

As another example, the initiation sensor 374 may be configured as a pressure activated switch. FIG. 6C is a perspective view showing a possible placement of a pressure activated switch 250 assembly in a recess 259 of the end-cap 270. The pressure activated switch 250 includes a fixed member 251, a deformable member 252, and a displacement member 256. In this embodiment of a pressure activated switch, the fixed member 251 is cylindrically shaped and may be disposed in the cylindrically shaped recess 259 and seated against a ledge (not shown) within the recess 259. A sealing material (not shown) may be placed in the recess 259 between the ledge and the fixed member 251 to form a high-pressure seal. In addition, the fixed member 251 includes a first annular channel 253 around the perimeter of the cylinder. This first annular channel 253, which may also be referred to as a seal gland, may also be filled with a sealing material to assist in forming a high-pressure and watertight seal.

The deformable member 252 may be a variety of devices or materials. By way of example, and not limitation, the deformable member 252 may be a piezoelectric device. The piezoelectric device may be configured between the fixed member 251 and the displacement member 256 such that movement of the displacement member 256 exerts a force on the piezoelectric device causing a change in a voltage across the piezoelectric material. Electrodes attached to the piezoelectric material may couple a signal to the data analysis module 300 (FIG. 6) for sampling at the initiation sensor 370 (FIG. 6). The piezoelectric device may be formed from any suitable piezoelectric material such as, for example, lead zirconate titanate (PZT), barium titanate, or quartz.

In FIG. 6C, the deformable member 252 is an O-ring that will deform somewhat when the displacement member 256 is forced closer to the fixed member 251. The modulus, or stiffness, of the O-ring may be selected for the desired pressure at which contact will be made. Of course, other displacement members 256, such as, for example, springs, are contemplated within the scope of the invention. As shown, the deformable member 252 is seated on a top surface of the fixed member 251. The displacement member 256 may be placed in the recess 259 on top of the deformable member 252 such that the displacement member 256 may move up and down within the recess 259 relative to the fixed member 251. The displacement member 256 is cylindrically shaped and includes a second annular channel 257 around the perimeter of the cylinder. This second annular channel 257, which may also be referred to as a seal gland, may also be filled with a sealing material to assist in forming a high-pressure and watertight seal. The displacement member 256 is made of an electrically conductive material, or the bottom surface of the displacement member 256 is coated with an electrically conductive material. A retaining clip 258 may be placed in the recess 259 in a configuration to hold the pressure activated switch 250 assembly in place within the recess 259.

Figure 6D:
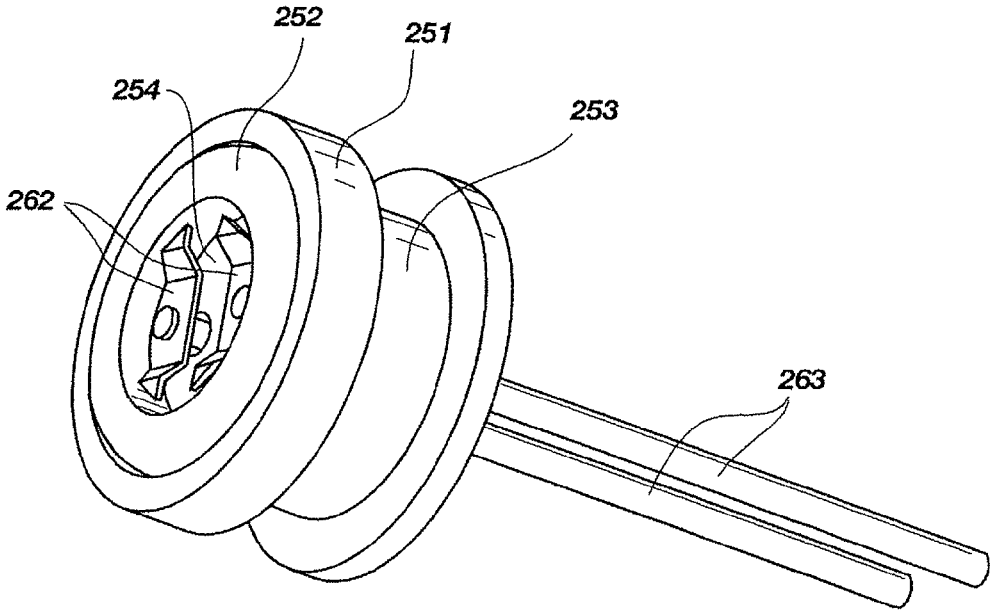
FIG. 6D is a perspective view of a fixed member portion of the pressure activated switch of FIG. 6C.

FIG. 6D is a perspective view showing details of the fixed member 251. The fixed member 251 includes the first annular channel 253 and the deformable member 252. In this embodiment, the fixed member 251 includes a borehole 254 therethrough such that leads 263 may be disposed through the borehole 254. The leads 263 are coupled to contacts 262 disposed in the borehole and slightly below the highest point of the deformable member 252. The borehole 254 may be filled with quartz glass or other suitable material to form a high-pressure seal.

In operation, the pressure activated switch 250 may be configured to activate the data analysis module 300 (not shown) as the drill bit traverses downhole when a given depth is achieved based on the hole pressure sensed by the pressure activated switch 250. In the configuration illustrated in FIG. 6C, the pressure activated switch 250 is actually sensing pressure of the mud within the drill string near the top of the drill bit. Due to hydrostatic pressure, the pressure within the drill string at the drill bit substantially matches the pressure in the borehole near the drill bit. However, as mud is pumped, there is a pressure differential. The increasing pressure exerts increasing force on the displacement member 256 causing it to displace toward the fixed member 251. As the displacement member 256 moves closer to the fixed member 251, it comes in contact with the contacts 262 forming a closed circuit between the leads 263. The leads 263 are coupled to the data analysis module 300 (not shown in FIGS. 6C and 6D) to perform the initiation function when the closed circuit is achieved.

In addition, while the embodiment of the pressure activated switch 250 has been described as disposed in a recess 259 of the end-cap 270, other placements are possible. For example, the cutouts illustrated in FIGS. 5A-5E may be suitable for placement of the pressure activated switch 250. Furthermore, while the discussion may have included directional indicators for ease of description, such as top, up, and down, the directions and orientations for placement of the pressure activated switch are not limited to those described.

The pressure activated switch is one of many types of sensors that may be placed in a recess such as that described in conjunction with the pressure activated switch. Any sensor that may need to be exposed to the environment of the borehole may be disposed in the recess with a configuration similar to the pressure activated switch to form a high-pressure and watertight seal within the drill bit. By way of example, and not limitation, some environmental sensors that may be used are passive gamma ray sensors, corrosion sensors, chlorine sensors, hydrogen sulfide sensors, proximity detectors for distance measurements to the borehole wall, and the like.

Figure 6E:
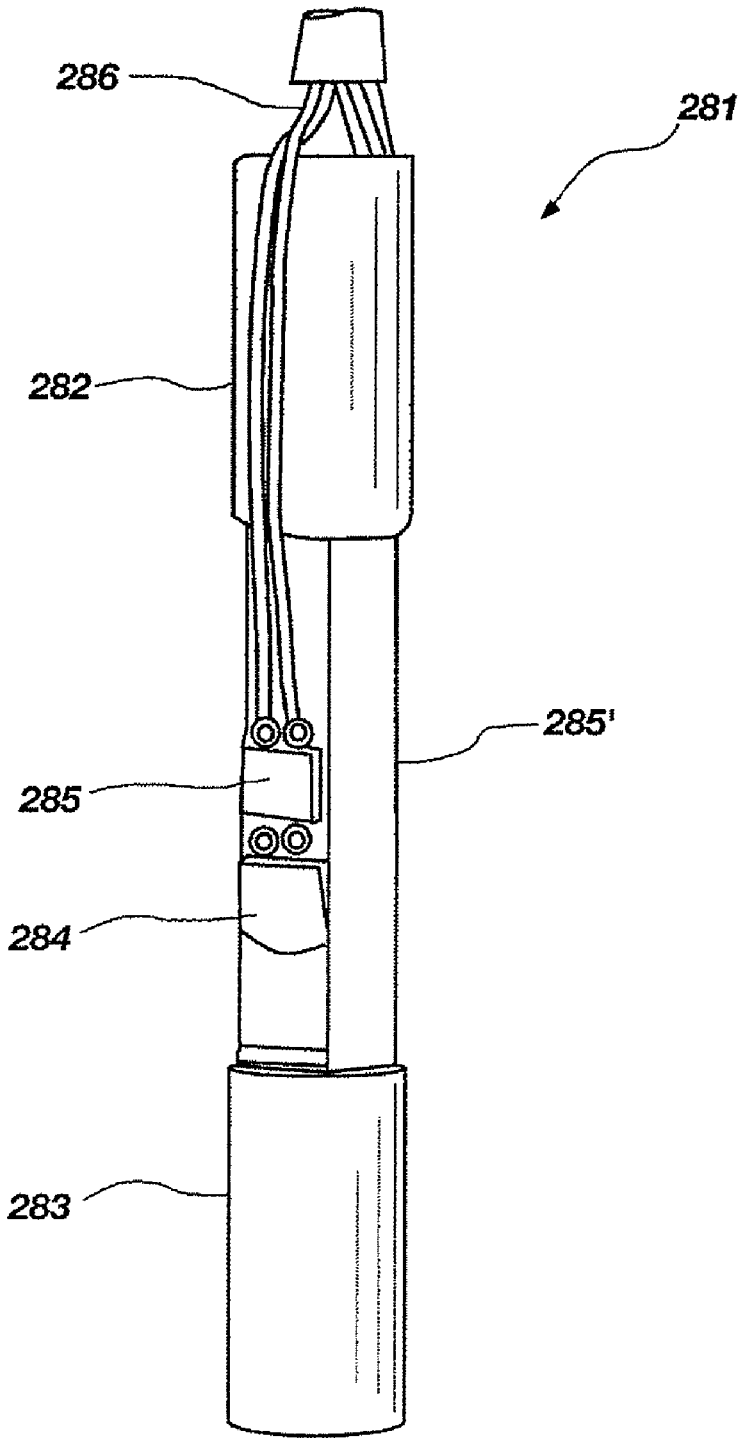
FIG. 6E is a perspective view of a load cell including strain gauges bonded thereon.

Another significant bit parameter to measure is stress and strain on the drill bit. However, just placing strain gauges on various areas of the drill bit or chambers within the drill bit may not produce optimal results. In an embodiment of the present invention, a load cell may be used to measure strain and infer stress information at the drill bit that may be more useful. FIG. 6E is a perspective view of a load cell 281 including strain gauges (285 and 285') bonded thereon. The load cell 281 includes a first attachment section 282, a stress section 284, and a second attachment section 283. The load cell 281 may be manufactured of a material, such as, for example, steel or other suitable metal that exhibits a suitable strain based on the expected loads than may be placed thereon. In the embodiment shown, the attachment sections (282 and 283) are cylindrical and the stress section 284 has a rectangular cross section. The rectangular cross section creates a flat surface for strain gauges 285 and 285' to be mounted thereon. In the embodiment shown, first strain gauges 285 are bonded to a front visible surface of the stress section 284 and second strain gauges 285' are bonded to a back hidden surface of the stress section 284. Of course, strain gauges 285 and 285' may be mounted on one, two, or more sides of the stress section 284, and the cross section of the stress section 284 may be other shapes, such as for example, hexagonal or octagonal. Conductors 286 from the strain gauges 285 and 285' extend upward through grooves formed in the first attachment section 282 and may be coupled to the data analysis module 300 (not shown in FIG. 6E).

Figure 6F:
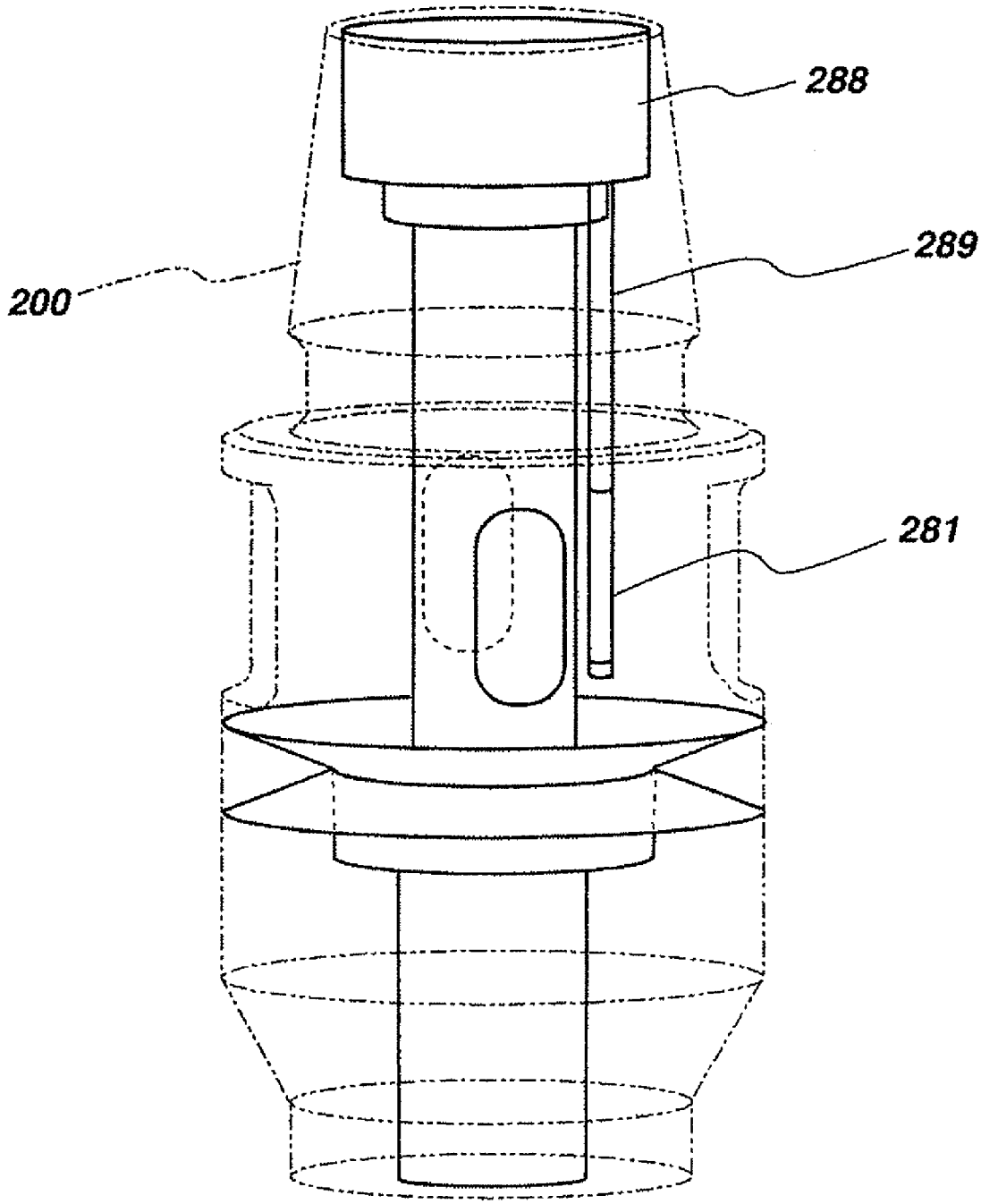
FIG. 6F is a perspective view showing an embodiment of one contemplated placement of the load cell in the bit body.

FIG. 6F is a perspective view showing one contemplated placement of the load cell 281 in the drill bit 200. A cylindrical tube 289 extends downward from a cavity 288 near the top of the drill bit 200 where the data analysis module 300 (not shown) may be placed. The tube 289 would extend into an area of the bit body that may be of particular interest and is configured such that the load cell 281 may be disposed and attached within the tube 289 and the conductors 286 (not shown in FIG. 6F) may extend through the tube 289 to the data analysis module. The load cell 281 may be attached within the tube 289 by any suitable means such that the first attachment section 282 and second attachment section 283 are held firmly in place. This attachment mechanism may be, for example, a secure press-fit, a threaded connection, an epoxy connection, a shape-memory retainer, and other suitable attachment mechanisms.

The load cell configuration may assist in obtaining more accurate strain measurements by using a load cell material that is more uniform, homogenous, and suitable for bonding strain gauges thereto when compared to bonding strain gauges directly to the bit body or sidewalls within a cavity in the bit body. The load cell configuration also may be more suitable for detecting torsional strain on the drill bit because the load cell creates a larger and more uniform displacement over which the torsional strain may occur due to the distance between the first attachment section and the second attachment section.

Furthermore, with the placement of the load cell 281, or strain gauges 285 and 285', in the drill bit 200, the load cell 281 may be placed in a specific desired orientation relative to elements of interest on or within the drill bit 200. With conventional placement of load cells, and other sensors, above the bit in another element of the drill string, it may be difficult to obtain the desired orientation due to the connection mechanism (e.g., threaded fittings) of the drill bit to the drill string. By way of example, embodiments of the present invention allow the load cell 281 to be placed in a specific orientation relative to elements of interest, such as a specific cutter, a specific leg of a tri-cone bit, or an index mark on the drill bit. In this way, additional information about specific elements of the bit may be obtained due to the specific and repeatable orientation of the load cell 281 relative to features of the drill bit 200.

By way of example, and not limitation, the load cell 281 may be rotated within the tube 289 to a specific orientation aligning with a specific cutter on the drill bit 200. As a result of this orientation, additional stress and strain information about the area of the drill bit near this specific cutter may be available. Furthermore, placement of the tube 289 at an angle relative to the central axis of the drill bit, or at different distances relative to the central axis of the drill bit, may enable more information about bending stresses relative to axial stresses placed on the drill bit, or specific areas of the drill bit.

This ability to place a sensor with a desired orientation relative to an arbitrary but repeatable feature of the drill bit is useful for other types of sensors, such as, for example, accelerometers, magnetometers, temperature sensors, and other environmental sensors.

The strain gauges may be connected in any suitable configuration, as are known by those of ordinary skill in the art, for detecting strain along different axes of the load cell. Such suitable configurations may include for example, Chevron or Poisson gage arrangements and full bridge, half bridge, or Wheatstone bridge circuits. Analysis of the strain gauge measurements can be used to develop bit parameters, such as, for example, stress on the bit, weight-on-bit, longitudinal stress, longitudinal strain, torsional stress, and torsional strain.

Returning to FIG. 6, the memory 330 may be used for storing sensor data, signal processing results, long-term data storage, and computer instructions for execution by the processor 320. Portions of the memory 330 may be located external to the processor 320 and portions may be located within the processor 320. The memory 330 may be Dynamic Random Access Memory (DRAM), Static Random Access Memory (SRAM), Read Only Memory (ROM), Nonvolatile Random Access Memory (NVRAM), such as Flash memory, Electrically Erasable Programmable ROM (EEPROM), or combinations thereof. In the FIG. 6 embodiment, the memory 330 is a combination of SRAM in the processor 320, Flash memory in the processor 320, and external Flash memory. Flash memory may be desirable for low-power operation and ability to retain information when no power is applied to the memory 330.

A communication port 350 may be included in the data analysis module 300 for communication to external devices such as the MWD communication system 146 and a remote processing system 390. The communication port 350 may be configured for a direct communication link 352 to the remote processing system 390 using a direct wire connection or a wireless communication protocol, such as, by way of example only, infrared, BLUETOOTH®, and 802.11a/b/g protocols. Using the direct communication, the data analysis module 300 may be configured to communicate with a remote processing system 390 such as, for example, a computer, a portable computer, and a personal digital assistant (PDA) when the drill bit 200 (FIG. 2) is not downhole. Thus, the direct communication link 352 may be used for a variety of functions, such as, for example, to download software and software upgrades, to enable setup of the data analysis module 300 by downloading configuration data, and to upload sample data and analysis data. The communication port 350 may also be used to query the data analysis module 300 for information related to the drill bit, such as, for example, bit serial number, data analysis module serial number, software version, total elapsed time of bit operation, and other long term drill bit data which may be stored in the NVRAM.

The communication port 350 may also be configured for communication with the MWD communication system 146 in a bottom hole assembly via a wired or wireless communication link 354 and protocol configured to enable remote communication across limited distances in a drilling environment as is known by those of ordinary skill in the art. One available technique for communicating data signals to an adjoining subassembly in the drill string 140 (FIG. 1) is depicted, described, and claimed in U.S. Pat. No. 4,884,071 entitled "Wellbore Tool With Hall Effect Coupling," which issued on Nov. 28, 1989 to Howard, and the disclosure of which is incorporated herein by reference.

The MWD communication system 146 may, in turn, communicate data from the data analysis module 300 to a remote processing system 390 using mud pulse telemetry 356 or other suitable communication means suitable for communication across the relatively large distances encountered in a drilling operation.

The processor 320 in the embodiment of FIG. 6 is configured for processing, analyzing, and storing collected sensor data. For sampling of the analog signals from the various sensors 340, the processor 320 of this embodiment includes a digital-to-analog converter (DAC). However, those of ordinary skill in the art will recognize that the present invention may be practiced with one or more external DACs in communication between the sensors 340 and the processor 320. In addition, the processor 320 in the embodiment includes internal SRAM and NVRAM. However, those of ordinary skill in the art will recognize that the present invention may be practiced with memory 330 that is only external to the processor 320 as well as in a configuration using no external memory 330 and only memory 330 internal to the processor 320.

The embodiment of FIG. 6 uses battery power as the operational power supply 310. Battery power enables operation without consideration of connection to another power source while in a drilling environment. However, with battery power, power conservation may become a significant consideration in the present invention. As a result, a low-power processor 320 and low-power memory 330 may enable longer battery life. Similarly, other power conservation techniques may be significant in the present invention.

The embodiment of FIG. 6, illustrates power controllers 316 for gating the application of power to the memory 330, the accelerometers 340A, and the magnetometers 340M. Using these power controllers 316, software running on the processor 320 may manage a power control bus 326 including control signals for individually enabling a voltage signal 314 to each component connected to the power control bus 326. While the voltage signal 314 is shown in FIG. 6 as a single signal, it will be understood by those of ordinary skill in the art that different components may require different voltages. Thus, the voltage signal 314 may be a bus including the voltages necessary for powering the different components.

In addition, software running on the processor 320 may be used to manage battery life intelligence and adaptive usage of power-consuming resources to conserve power. The battery life intelligence can track the remaining battery life (i.e., charge remaining on the battery) and use this tracking to manage other processes within the system. By way of example, the battery life estimate may be determined by sampling a voltage from the battery, sampling a current from the battery, tracking a history of sampled voltage, tracking a history of sampled current, and combinations thereof.

The battery life estimate may be used in a number of ways. For example, near the end of battery life, the software may reduce sampling frequency of sensors, or may be used to cause the power control bus to begin shutting down voltage signals to various components.

This power management can create a graceful, gradual shutdown. For example, perhaps power to the magnetometers is shut down at a certain point of remaining battery life. At another point of battery life, perhaps the accelerometers are shut down. Near the end of battery life, the battery life intelligence can ensure data integrity by making sure improper data is not gathered or stored due to inadequate voltage at the sensors, the processor, or the memory.

As is explained more fully below with reference to specific types of data gathering, software modules may be devoted to memory management with respect to data storage. The amount of data stored may be modified with adaptive sampling and data compression techniques. For example, data may be originally stored in an uncompressed form. Later, when memory space becomes limited, the data may be compressed to free up additional memory space. In addition, data may be assigned priorities such that when memory space becomes limited high-priority data is preserved and low-priority data may be overwritten.

Software modules may also be included to track the long-term history of the drill bit. Thus, based on drilling performance data gathered over the lifetime of the drill bit, a life estimate of the drill bit may be formed. Failure of a drill bit can be a very expensive problem. With life estimates based on actual drilling performance data, the software module may be configured to determine when a drill bit is nearing the end of its useful life and use the communication port to signal to external devices the expected life remaining on the drill bit.

Figure 7A:
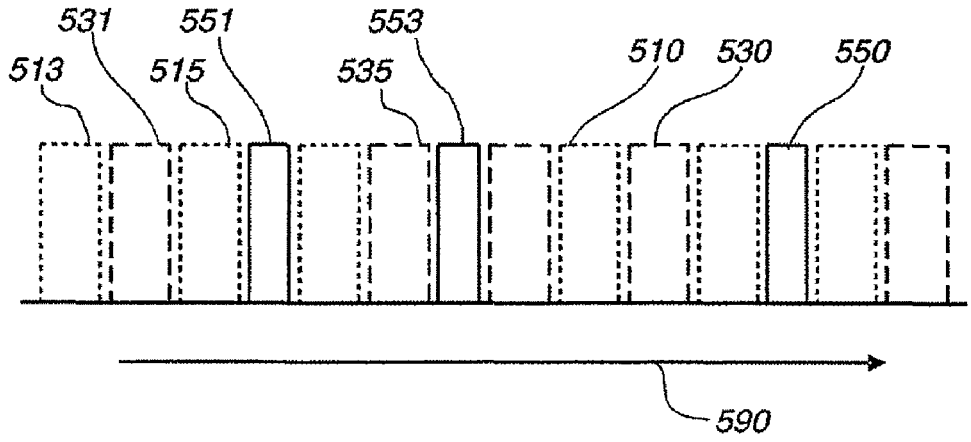
FIG. 7A is an example of a timing diagram illustrating various data sampling modes and transitions between the modes based on a time-based event trigger.
Figure 7B:
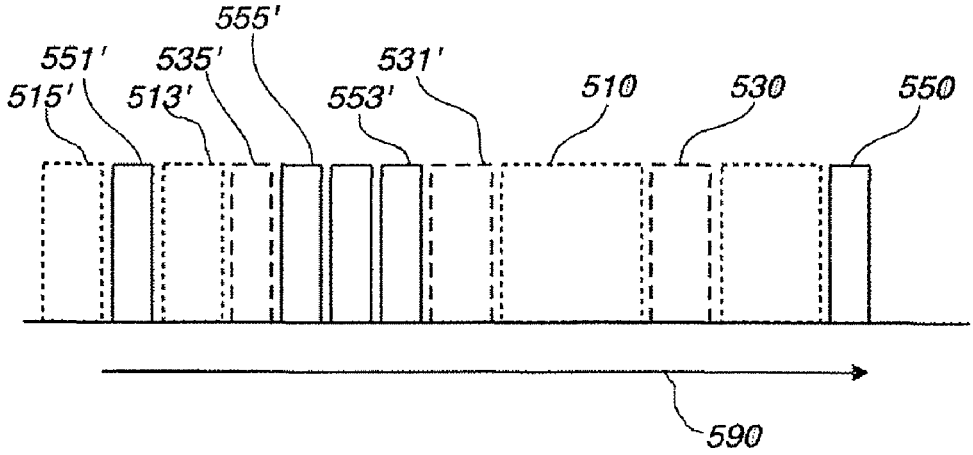
FIG. 7B is an example of a timing diagram illustrating various data sampling modes and transitions between the modes based on an adaptive-threshold-based event trigger.

FIGS. 7A and 7B illustrate some examples of data sampling modes occurring along an increasing time axis 590 that the data analysis module 300 (FIG. 6) may perform. The data sampling modes may include a background mode 510, a logging mode 530, and a burst mode 550. The different modes may be characterized by what type of sensor data is sampled and analyzed as well as at what sampling frequency the sensor data is sampled.

The background mode 510 may be used for sampling data at a relatively low background sampling frequency and generating background data from a subset of all the available sensors 340 (FIG.6). The logging mode 530 may be used for sampling logging data at a relatively mid-level logging sampling frequency and with a larger subset, or all, of the available sensors 340. The burst mode 550 may be used for sampling burst data at a relatively high burst sampling frequency and with a large subset, or all, of the available sensors 340.

Each of the different data modes may collect, process, and analyze data from a subset of sensors at a predefined sampling frequency and for a predefined block size. By way of example, and not limitation, examples of sampling frequencies, and block collection sizes may be: 2 or 5 samples/sec, and 200 seconds worth of samples per block for background mode, 100 samples/sec, and ten seconds worth of samples per block for logging mode, and 200 samples/sec, and five seconds worth of samples per block for burst mode. Some embodiments of the invention may be constrained by the amount of memory available, the amount of power available or combination thereof.

More memory, more power, or combination thereof may be required for more detailed modes, therefore, the adaptive threshold triggering enables a method of optimizing memory usage, power usage, or combination thereof, relative to collecting and processing the most useful and detailed information. For example, the adaptive threshold triggering may be adapted for detection of specific types of known events, such as, for example, bit whirl, bit bounce, bit wobble, bit walking, lateral vibration, and torsional oscillation.

Generally, the data analysis module 300 (FIG. 6) may be configured to transition from one mode to another mode based on some type of event trigger. FIG. 7A illustrates a timing triggered mode wherein the transition from one mode to another is based on a timing event, such as, for example, collecting a predefined number of samples, or expiration of a timing counter. Timing point 513 illustrates a transition from the background mode 510 to the logging mode 530 due to a timing event. Timing point 531 illustrates a transition from the logging mode 530 to the background mode 510 due to a timing event. Timing point 515 illustrates a transition from the background mode 510 to the burst mode 550 due to a timing event. Timing point 551 illustrates a transition from the burst mode 550 to the background mode 510 due to a timing event. Timing point 535 illustrates a transition from the logging mode 530 to the burst mode 550 due to a timing event. Finally, timing point 553 illustrates a transition from the burst mode 550 to the logging mode 530 due to a timing event.

FIG. 7B illustrates an adaptive sampling trigger mode wherein the transition from one mode to another is based on analysis of the collected data to create a severity index and whether the severity index is greater than or less than an adaptive threshold. The adaptive threshold may be a predetermined value, or it may be modified based on signal processing analysis of the past history of collected data. Timing point 513' illustrates a transition from the background mode 510 to the logging mode 530 due to an adaptive threshold event. Timing point 531' illustrates a transition from the logging mode 530 to the background mode 510 due to a timing event. Timing point 515' illustrates a transition from the background mode 510 to the burst mode 550 due to an adaptive threshold event. Timing point 551' illustrates a transition from the burst mode 550 to the background mode 510 due to an adaptive threshold event. Timing point 535' illustrates a transition from the logging mode 530 to the burst mode 550 due to an adaptive threshold event. Finally, timing point 553' illustrates a transition from the burst mode 550 to the logging mode 530 due to an adaptive threshold event. In addition, the data analysis module 300 (FIG. 6) may remain in any given data sampling mode from one sampling block to the next sampling block, if no adaptive threshold event is detected, as illustrated by timing point 555'.

The software, which may also be referred to as firmware, for the data analysis module 300 comprises computer instructions for execution by the processor 320. The software may reside in an external memory 330, or memory within the processor 320. FIGS. 8A-8H illustrate major functions of embodiments of the software according to the present invention.

Before describing the main routine in detail, a basic function to collect and queue data, which may be performed by the processor and analog-to-digital converter (ADC) is described. The ADC routine 780, illustrated in FIG. 8A, may operate from a timer in the processor, which may be set to generate an interrupt at a predefined sampling interval. The interval may be repeated to create a sampling interval clock on which to perform data sampling in the ADC routine 780. The ADC routine 780 may collect data from the accelerometers, the magnetometers, the temperature sensors, and any other optional sensors by performing an analog to digital conversion on any sensors that may present measurements as an analog source. Block 802 shows measurements and calculations that may be performed for the various sensors while in the background mode. Block 804 shows measurements and calculations that may be performed for the various sensors while in the logging mode. Block 806 shows measurements and calculations that may be performed for the various sensors while in the burst mode. The ADC routine 780 is entered when the timer interrupt occurs. A decision block 782 determines under which data mode the data analysis module is currently operating.

If in the burst mode 550, samples are collected (794 and 796) for all the accelerometers and all the magnetometers. The sampled data from each accelerometer and each magnetometer is stored in a burst data record. The ADC routine 780 then sets 798 a data ready flag indicating to the main routine that data is ready to process.

If in the background mode 510, samples are collected 784 for all the accelerometers. As the ADC routine 780 collects data from each accelerometer it adds the sampled value to a stored value containing a sum of previous accelerometer measurements to create a running sum of accelerometer measurements for each accelerometer. The ADC routine 780 also adds the square of the sampled value to a stored value containing a sum of previous squared values to create a running sum of squares value for the accelerometer measurements. The ADC routine 780 also increments the background data sample counter to indicate that another background sample as been collected Optionally, temperature and sum of temperatures may also be collected and calculated.

If in the logging mode 530, samples are collected (786, 788, and 790) for all the accelerometers, all the magnetometers, and the temperature sensor. The ADC routine 780 collects a sampled value from each accelerometer and each magnetometer and adds the sampled value to a stored value containing a sum of previous accelerometer and magnetometer measurements to create a running sum of accelerometer measurements and a running sum of magnetometer measurements. In addition, the ADC routine 780 compares the current sample for each accelerometer and magnetometer measurement to a stored minimum value for each accelerometer and magnetometer. If the current sample is smaller than the stored minimum, the current sample is saved as the new stored minimum. Thus, the ADC routine 780 keeps the minimum value sampled for all samples collected in the current data block. Similarly, to keep the maximum value sampled for all samples collected in the current data block, the ADC routine 780 compares the current sample for each accelerometer and magnetometer measurement to a stored maximum value for each accelerometer and magnetometer. If the current sample is larger than the stored maximum, the current sample is saved as the new stored maximum. The ADC routine 780 also creates a running sum of temperature values by adding the current sample for the temperature sensor to a stored value of a sum of previous temperature measurements. The ADC routine 780 then sets 792 a data ready flag indicating to the main routine that data is ready to process.

Figure 8A:
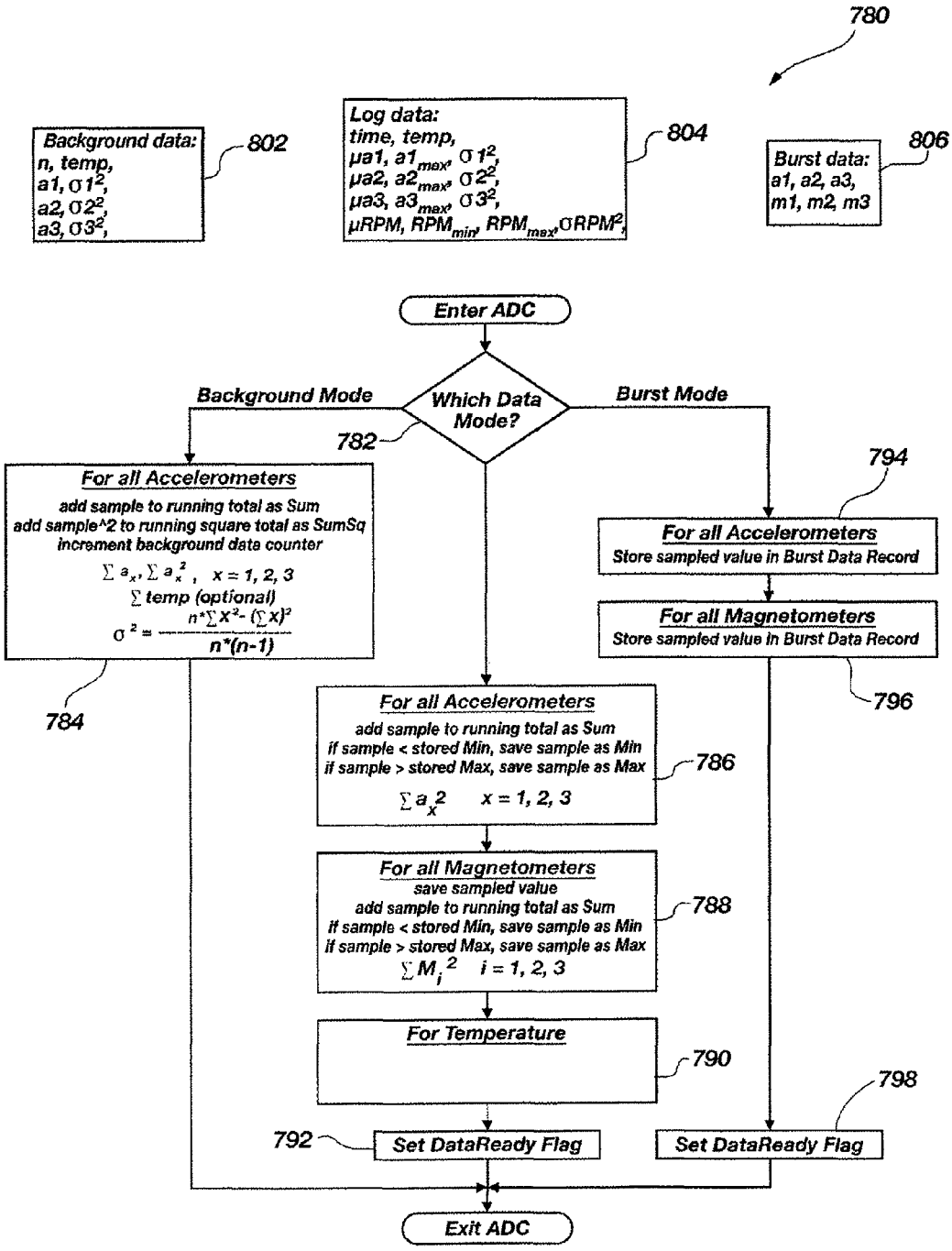
FIGS. 8A-8H are flow diagrams illustrating embodiments of operation of the data analysis module in sampling values from various sensors, saving sampled data, and analyzing sampled data to determine adaptive threshold event triggers in accordance with the invention.
Figure 8B:
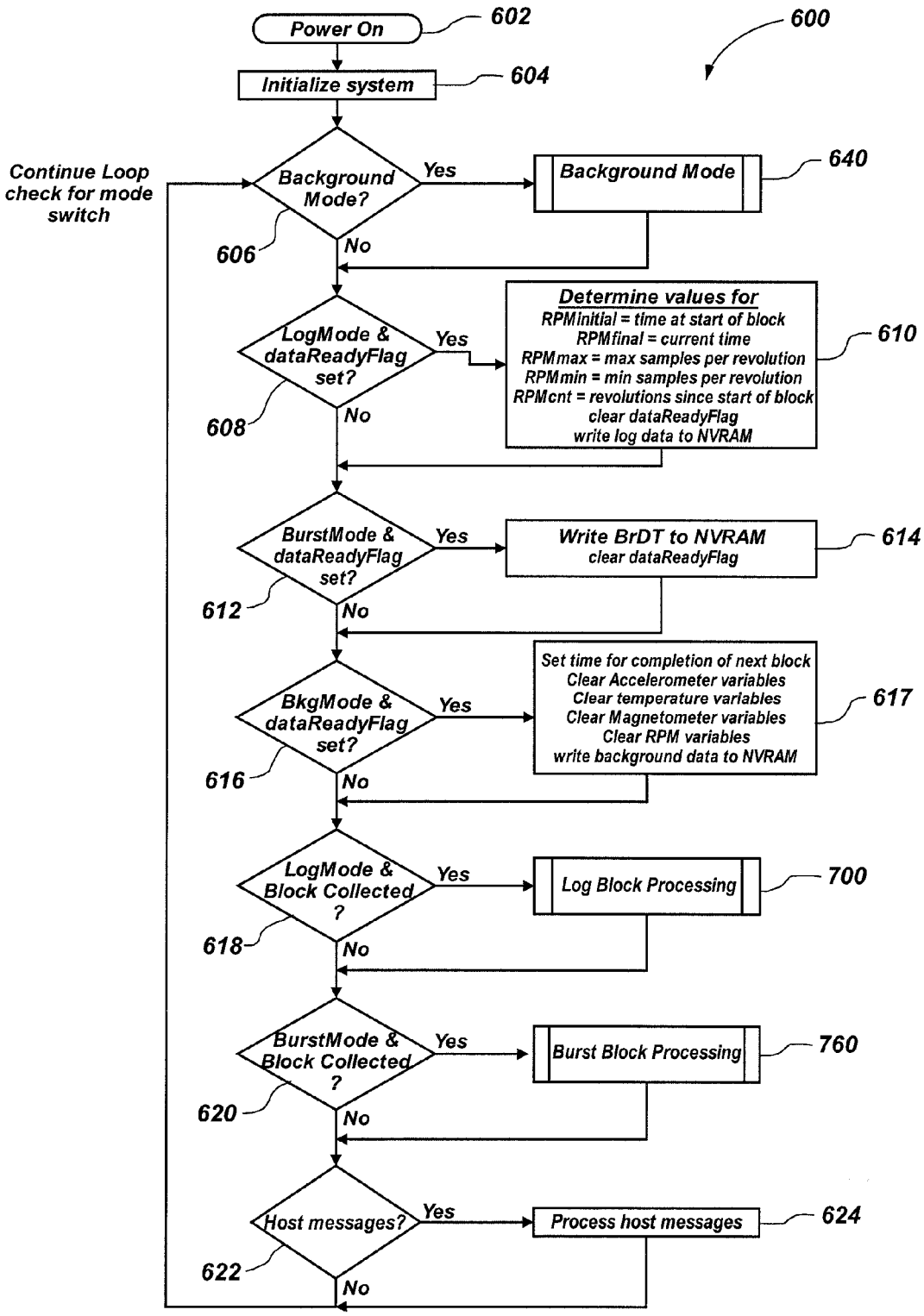

FIG. 8B illustrates major functions of the main routine 600. After power on 602, the main software routine initializes 604 the system by setting up memory, enabling communication ports, enabling the ADC, and generally setting up parameters required to control the data analysis module. The main routine 600 then enters a loop to begin processing collected data. The main routine 600 primarily makes decisions about whether data collected by the ADC routine 780 (FIG. 8A) is available for processing, which data mode is currently active, and whether an entire block of data for the given data mode has been collected. As a result of these decisions, the main routine 600 may perform mode processing for any of the given modes if data is available, but an entire block of data has not yet been processed. On the other hand, if an entire block of data is available, the main routine 600 may perform block processing for any of the given modes.

As illustrated in FIG. 8B, to begin the decision process, a test 606 is performed to see if the operating mode is currently set to background mode. If so, background mode processing 640 begins. If test 606 fails or after background mode processing 640, a test 608 is performed to see if the operating mode is set to logging mode and the data ready flag from the ADC routine 780 is set. If so, logging operations 610 are performed. These operations will be described more fully below. If test 608 fails or after the logging operations 610, a test 612 is performed to see if the operating mode is set to burst mode and the data ready flag from the ADC routine 780 is set. If so, burst operations 614 are performed. These operations will be described more fully below. If test 612 fails or after the burst operations 614, a test 616 is performed to see if the operating mode is set to background mode and an entire block of background data has been collected. If so, background block processing 617 is performed. If test 616 fails or after background block processing 617, a test 618 is performed to see if the operating mode is set to logging mode and an entire block of logging data has been collected. If so, log block processing 700 is performed. If test 618 fails or after log block processing 700, a test 620 is performed to see if the operating mode is set to burst mode and an entire block of burst data has been collected. If so, burst block processing 760 is performed. If test 620 fails or after burst block processing 760, a test 622 is performed to see if the there are any host messages to be processed from the communication port. If so, the host messages are processed 624. If test 622 fails or after host messages are processed, the main routine 600 loops back to test 606 to begin another loop of tests to see if any data, and what type of data, may be available for processing. This loop continues indefinitely while the data analysis module is set to a data collection mode.

Details of logging operations 610 are illustrated in FIG. 8B. In this example of a logging mode, data is analyzed for magnetometers in at least the X and Y directions to determine how fast the drill bit is rotating. In performing this analysis the software maintains variables for a time stamp at the beginning of the logging block (RPMinitial), a time stamp of the current data sample time (RPMfinal), a variable containing the maximum number of time ticks per bit revolution (RPMmax), a variable containing the minimum number of time ticks per bit revolution (RPMmin), and a variable containing the current number of bit revolutions (RPMcnt) since the beginning of the log block. The resulting log data calculated during the ADC routine 780 and during logging operations 610 may be written to nonvolatile RAM.

Magnetometers may be used to determine bit revolutions because the magnetometers are rotating in the earth's magnetic field. If the bit is positioned vertically, the determination is a relatively simple operation of comparing the history of samples from the X magnetometer and the Y magnetometer. For bits positioned at an angle, perhaps due to directional drilling, the calculations may be more involved and require samples from all three magnetometers.

Details of burst operations 614 are also illustrated in FIG. 8B. Burst operations 614 are relatively simple in this embodiment. The burst data collected by the ADC routine 780 is stored in NVRAM and the data ready flag is cleared to prepare for the next burst sample.

Details of background block processing 617 are also illustrated in FIG. 8B. At the end of a background block, clean up operations are performed to prepare for a new background block. To prepare for a new background block, a completion time is set for the next background block, the variables tracked relating to accelerometers are set to initial values, the variables tracked relating to temperature are set to initial values, the variables tracked relating to magnetometers are set to initial values, and the variables tracked relating to RPM calculations are set to initial values. The resulting background data calculated during the ADC routine 780 and during background block processing 617 may be written to nonvolatile RAM.

In performing adaptive sampling, decisions may be made by the software as to what type of data mode is currently operating and whether to switch to a different data mode based on timing event triggers or adaptive threshold triggers. The adaptive threshold triggers may generally be viewed as a test between a severity index and an adaptive threshold. At least three possible outcomes are possible from this test. As a result of this test, a transition may occur to a more detailed mode of data collection, to a less detailed mode of data collection, or no transition may occur.

These data modes are defined as the background mode 510 being the least detailed, the logging mode 530 being more detailed than the background mode 510, and the burst mode 550 being more detailed than the logging mode 530.

A different severity index may be defined for each data mode. Any given severity index may comprise a sampled value from a sensor, a mathematical combination of a variety of sensor's samples, or a signal processing result including historical samples from a variety of sensors. Generally, the severity index gives a measure of particular phenomena of interest. For example, a severity index may be a combination of mean square error calculations for the values sensed by the X accelerometer and the Y accelerometer.

In its simplest form, an adaptive threshold may be defined as a specific threshold (possibly stored as a constant) for which, if the severity index is greater than or less than the adaptive threshold the data analysis module may switch (i.e., adapt sampling) to a new data mode. In more complex forms, an adaptive threshold may change its value (i.e., adapt the threshold value) to a new value based on historical data samples or signal processing analysis of historical data samples.

In general, two adaptive thresholds may be defined for each data mode: a lower adaptive threshold (also referred to as a first threshold) and an upper adaptive threshold (also referred to as a second threshold). Tests of the severity index against the adaptive thresholds may be used to decide if a data mode switch is desirable.

Figure 8C:
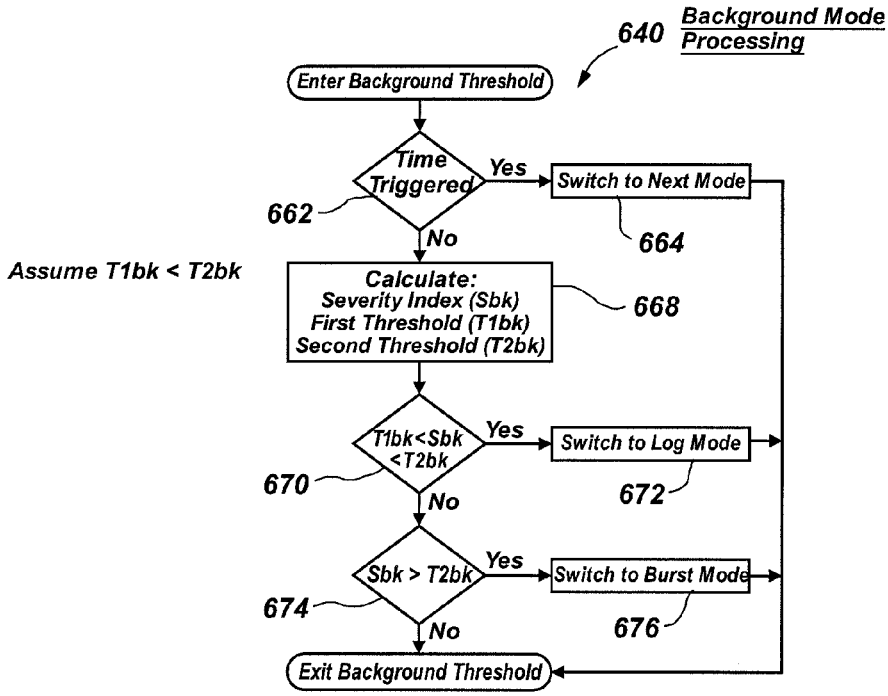
Figure 8D:
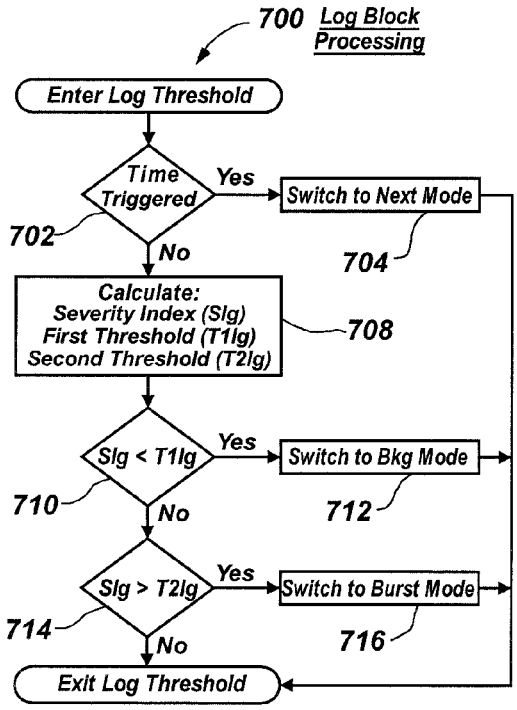
Figure 8E:
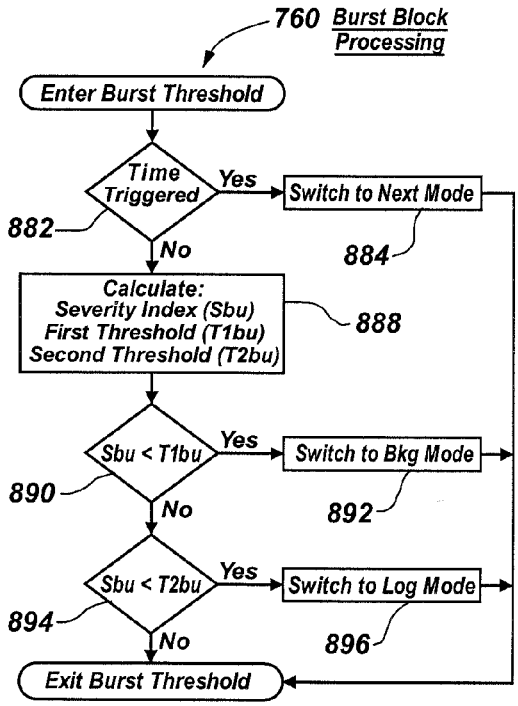

In the computer instructions illustrated in FIGS. 8C-8E, and defining a flexible embodiment relative to the main routine 600 (FIG. 8B), adaptive threshold decisions are fully illustrated, but details of data processing and data gathering may not be illustrated.

FIG. 8C illustrates general adaptive threshold testing relative to background mode processing 640. First, test 662 is performed to see if a time trigger mode is active. If so, operation block 664 causes the data mode to possibly switch to a different mode. Based on a predetermined algorithm, the data mode may switch to logging mode, burst mode, or may stay in background mode for a predetermined time longer. After switching data modes, the software exits background mode processing 640.

If test 662 fails, adaptive threshold triggering is active, and operation block 668 calculates a background severity index (Sbk), a first background threshold (T1*bk*), and a second background threshold (T2*bk*). Then, test 670 is performed to see if the background severity index is between the first background threshold and the second background threshold. If so, operation block 672 switches the data mode to logging mode and the software exits background mode processing 640.

If test 670 fails, test 674 is performed to see if the background severity index is greater than the second background threshold. If so, operation block 676 switches the data mode to burst mode and the software exits background mode processing. If test 674 fails, the data mode remains in background mode and the software exits background mode processing 640.

FIG. 8D illustrates general adaptive threshold testing relative to log block processing 700. First, test 702 is performed to see if time trigger mode is active. If so, operation block 704 causes the data mode to possibly switch to a different mode. Based on a predetermined algorithm, the data mode may switch to background mode, burst mode, or may stay in logging mode for a predetermined time longer. After switching data modes, the software exits log block processing 700.

If test 702 fails, adaptive threshold triggering is active, and operation block 708 calculates a logging severity index (Slg), a first logging threshold (T1*lg*), and a second logging threshold (T2*lg*). Then, test 710 is performed to see if the logging severity index is less than the first logging threshold. If so, operation block 712 switches the data mode to background mode and the software exits log block processing 700.

If test 710 fails, test 714 is performed to see if the logging severity index is greater than the second logging threshold. If so, operation block 716 switches the data mode to burst mode and the software exits log block processing. If test 714 fails, the data mode remains in logging mode and the software exits log block processing 700.

FIG. 8E illustrates general adaptive threshold testing relative to burst block processing 760. First, test 882 is performed to see if time trigger mode is active. If so, operation block 884 causes the data mode to possibly switch to a different mode. Based on a predetermined algorithm, the data mode may switch to background mode, logging mode, or may stay in burst mode for a predetermined time longer. After switching data modes, the software exits burst block processing 760.

If test 882 fails, adaptive threshold triggering is active, and operation block 888 calculates a burst severity index (Sbu), a first burst threshold (T1*bu*), and a second burst threshold (T2*bu*). Then, test 890 is performed to see if the burst severity index is less than the first burst threshold. If so, operation block 892 switches the data mode to background mode and the software exits burst block processing 760.

If test 890 fails, test 894 is performed to see if the burst severity index is less than the second burst threshold. If so, operation block 896 switches the data mode to logging mode and the software exits burst block processing. If test 894 fails, the data mode remains in burst mode and the software exits burst block processing 760.

Figure 8F:
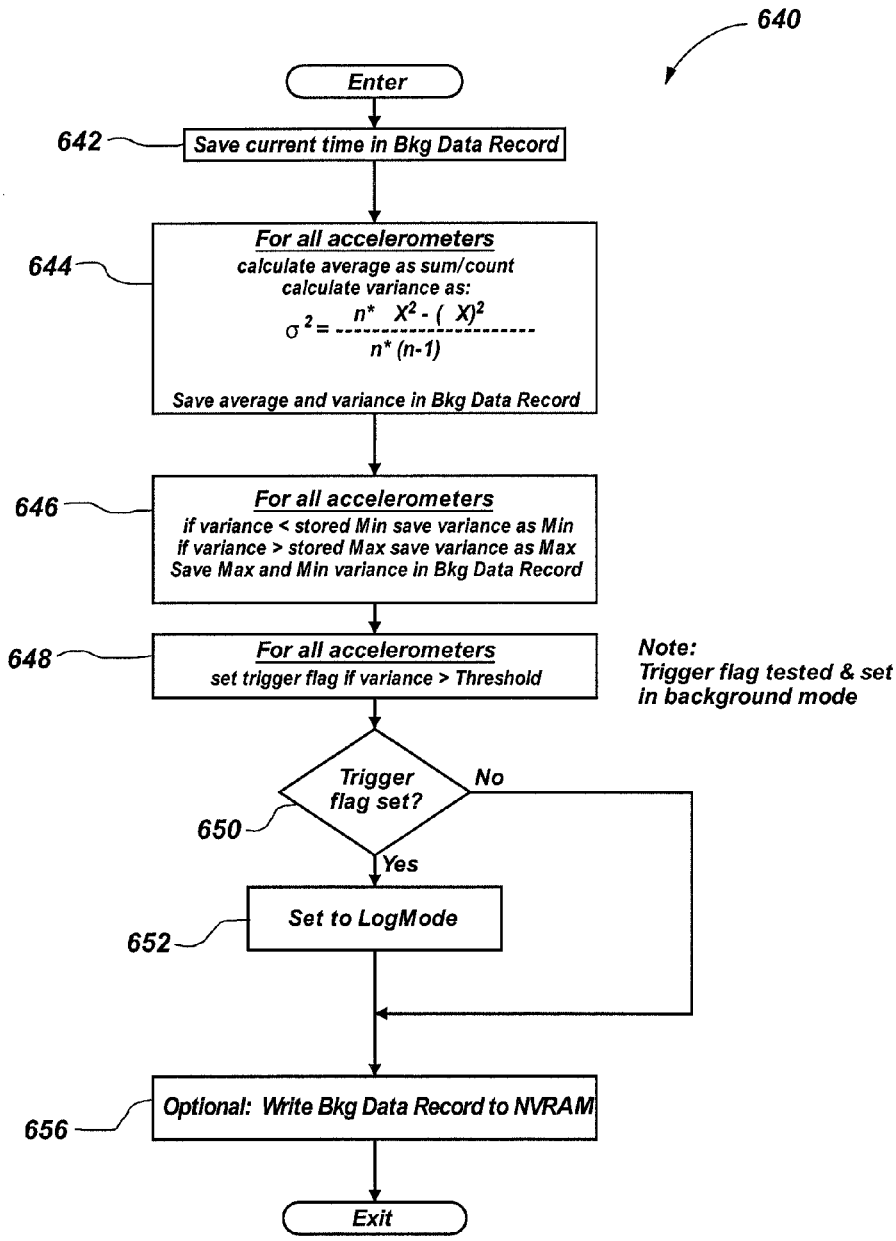
Figure 8G:
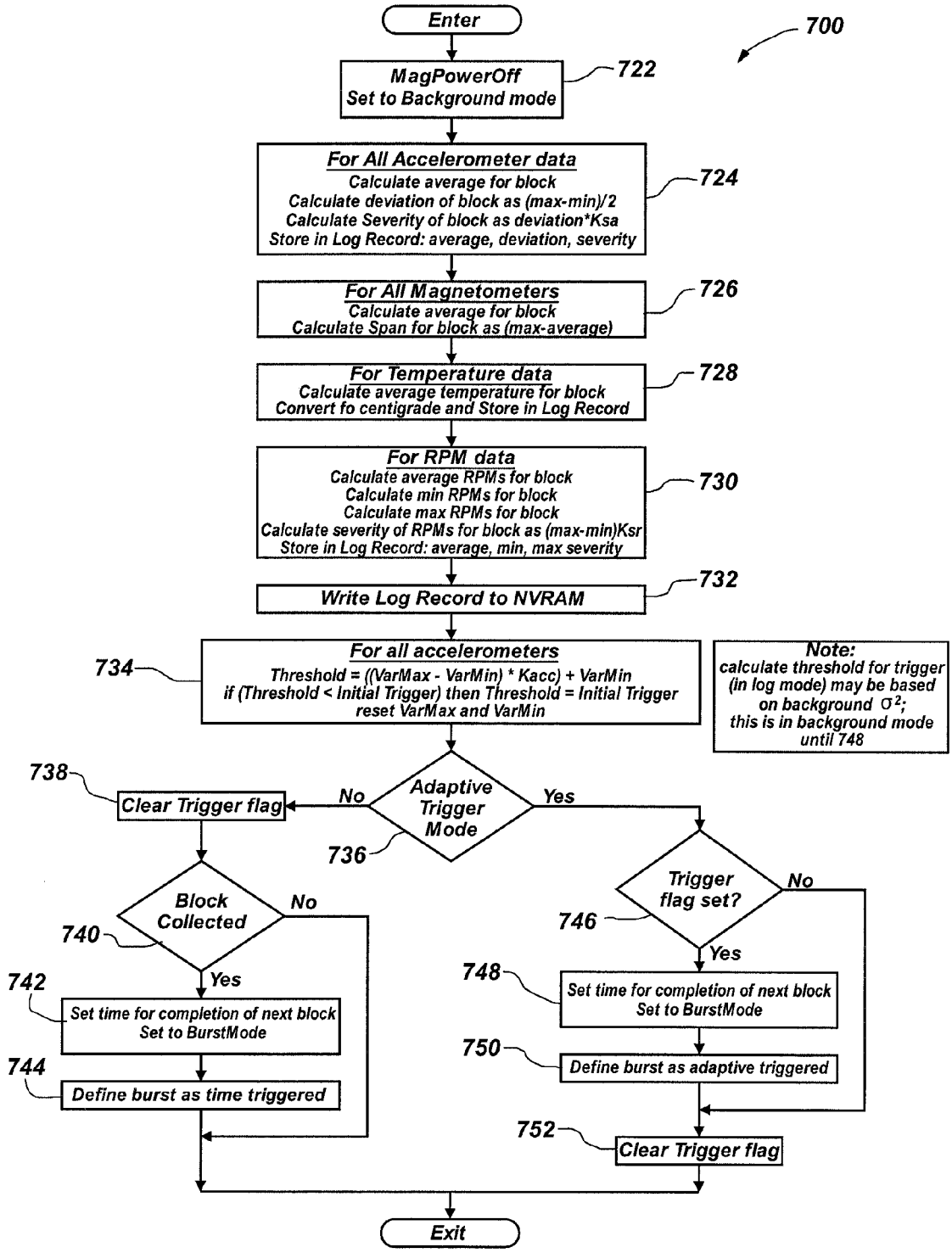
Figure 8H:
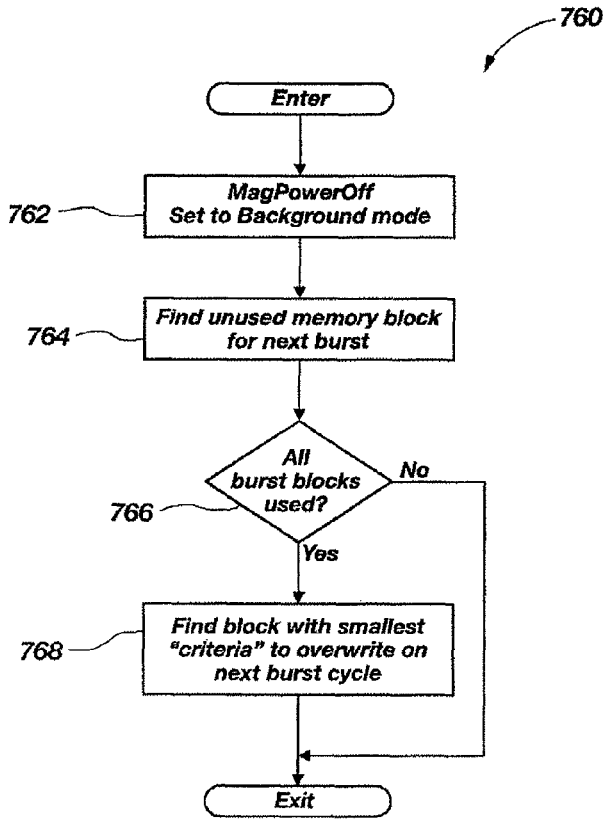

In the computer instructions illustrated in FIGS. 8F-8H, and defining another embodiment of processing relative to the main routine 600 (FIG. 8B), more details of data gathering and data processing are illustrated, but not all decisions are explained and illustrated. Rather, a variety of decisions are shown to further illustrate the general concept of adaptive threshold triggering.

Details of another embodiment of background mode processing 640 are illustrated in FIG. 8F. In this background mode embodiment, data is collected for accelerometers in the X, Y, and Z directions. The ADC routine 780 (FIG. 8A) stored data as a running sum of all background samples and a running sum of squares of all background data for each of the X, Y, and Z accelerometers. In the background mode processing, the parameters of an average, a variance, a maximum variance, and a minimum variance for each of the accelerometers are calculated and stored in a background data record. First, the software saves 642 the current time stamp in the background data record. Then the parameters are calculated as illustrated in operation blocks 644 and 646. The average may be calculated as the running sum divided by the number of samples currently collected for operation block 644. The variance may be set as a mean square value using the equations as shown in operation block 646. The minimum variance is determined by setting the current variance as the minimum if it is less than any previous value for the minimum variance. Similarly, the maximum variance is determined by setting the current variance as the maximum variance if it is greater than any previous value for the maximum variance. Next, a trigger flag is set 648 if the variance (also referred to as the background severity index) is greater than a background threshold, which in this case is a predetermined value set prior to starting the software. The trigger flag is tested 650.

If the trigger flag is not set, the software jumps down to operation block 656. If the trigger flag is set, the software transitions 652 to logging mode. After the switch to logging mode, or if the trigger flag is not set, the software may optionally write 656 the contents of background data record to the NVRAM. In some embodiments, it may not be desirable to use NVRAM space for background data. While in other embodiments, it may be valuable to maintain at least a partial history of data collected while in background mode.

Figure 9:
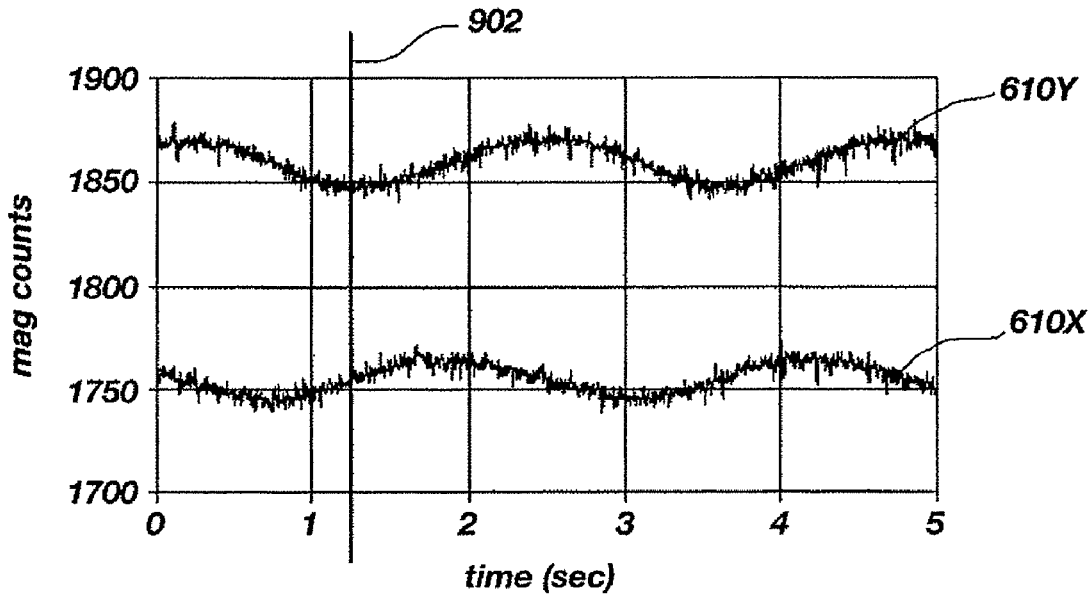
FIG. 9 illustrates examples of data sampled from magnetometer sensors along two axes of a rotating Cartesian coordinate system.

Referring to FIG. 9, magnetometer samples' histories are shown for X magnetometer samples 610X and Y magnetometer samples 610Y. Looking at sample point 902, it can be seen that the Y magnetometer samples 610Y are near a minimum and the X magnetometer samples 610X are at a phase of about 90 degrees. By tracking the history of these samples, the software can detect when a complete revolution has occurred. For example, the software can detect when the X magnetometer samples 610X have become positive (i.e., greater than a selected value) as a starting point of a revolution. The software can then detect when the Y magnetometer samples 610Y have become positive (i.e., greater than a selected value) as an indication that revolutions are occurring. Then, the software can detect the next time the X magnetometer samples 610X become positive, indicating a complete revolution. Each time a revolution occurs, the logging operation updates the logging variables described above.

Details of another embodiment of log block processing 700 are illustrated in FIG. 8G. In this log block processing embodiment, the software assumes that the data mode will be reset to the background mode. Thus, power to the magnetometers is shut off and the background mode is set 722. This data mode may be changed later in the log block processing 700 if the background mode is not appropriate. In the log block processing 700, the parameters of an average, a deviation, and a severity for each of the accelerometers are calculated and stored in a log data record. The parameters are calculated as illustrated in operation block 724. The average may be calculated as the running sum prepared by the ADC routine 780 (FIG. 8A) divided by the number of samples currently collected for this block. The deviation is set as one-half of the quantity of the maximum value set by the ADC routine 780 less the minimum value set by the ADC routine 780. The severity is set as the deviation multiplied by a constant (Ksa), which may be set as a configuration parameter prior to software operation. For each magnetometer, the parameters of an average and a span are calculated and stored 726 in the log data record. For the temperature, an average is calculated and stored 728 in the log data record. For the RPM data generated during the log mode processing 610 (in FIG. 8B), the parameters of an average RPM, a minimum RPM, a maximum RPM, and a RPM severity are calculated and stored 730 in the log data record. The severity is set as the maximum RPM minus the minimum RPM multiplied by a constant (Ksr), which may be set as a configuration parameter prior to software operation. After all parameters are calculated, the log data record is stored 732 in NVRAM. For each accelerometer in the system, a threshold value is calculated at block 734 for use in determining whether an adaptive trigger flag should be set. The threshold value, as defined in block 734, is compared to an initial trigger value. If the threshold value is less than the initial trigger value, the threshold value is set to the initial trigger value.

Once all parameters for storage and adaptive triggering are calculated, a test 736 is performed to determine whether the mode is currently set to adaptive triggering or time-based triggering. If the test fails (i.e., time-based triggering is active), the trigger flag is cleared 738. A test 740 is performed to verify that data collection is at the end of a logging data block. If not, the software exits the log block processing 700. If data collection is at the end of a logging data block, burst mode is set 742, and the time for completion of the burst block is set. In addition, the burst block to be captured is defined as time triggered 744.

If the test 736 for adaptive triggering passes, a test 746 is performed to verify that a trigger flag is set, indicating that, based on the adaptive trigger calculations, burst mode should be entered to collect more detailed information. If test 746 passes, burst mode is set 748, and the time for completion of the burst block is set. In addition, the burst block to be captured is defined as adaptive triggered 750. If test 746 fails or after defining the burst block as adaptive triggered, the trigger flag is cleared 752 and log block processing 700 is complete.

Details of another embodiment of burst block processing 760 are illustrated in FIG. 8H. In this embodiment, a burst severity index is not implemented. Instead, the software always returns to the background mode after completion of a burst block. First, power may be turned off to the magnetometers to conserve power and the software transitions 762 to the background mode.

After many burst blocks have been processed, the amount of memory allocated to storing burst samples may be completely consumed. If this is the case, a previously stored burst block may need to be set to be overwritten by samples from the next burst block. The software checks 764 to see if any unused NVRAM is available for burst block data. If not all burst blocks are used, the software exits the burst block processing 760. If all burst blocks are used 766, the software uses an algorithm to find 768 a good candidate for overwriting.

It will be recognized and appreciated by those of ordinary skill in the art, that the main routine 600, illustrated in FIG. 8B, switches to adaptive threshold testing after each sample in background mode, but only after a block is collected in logging mode and burst mode. Of course, the adaptive threshold testing may be adapted to be performed after every sample in each mode, or after a full block is collected in each mode. Furthermore, the ADC routine 780, illustrated in FIG. 8A, illustrates a non-limiting example of an implementation of data collection and analysis. Many other data collection and analysis operations are contemplated as within the scope of the present invention.

More memory, more power, or combination thereof, may be required for more detailed modes, therefore, the adaptive threshold triggering enables a method of optimizing memory usage, power usage, or combination thereof, relative to collecting and processing the most useful and detailed information. For example, the adaptive threshold triggering may be adapted for detection of specific types of known event, such as, for example, bit whirl, bit bounce, bit wobble, bit walking, lateral vibration, and torsional oscillation.

Figure 10:
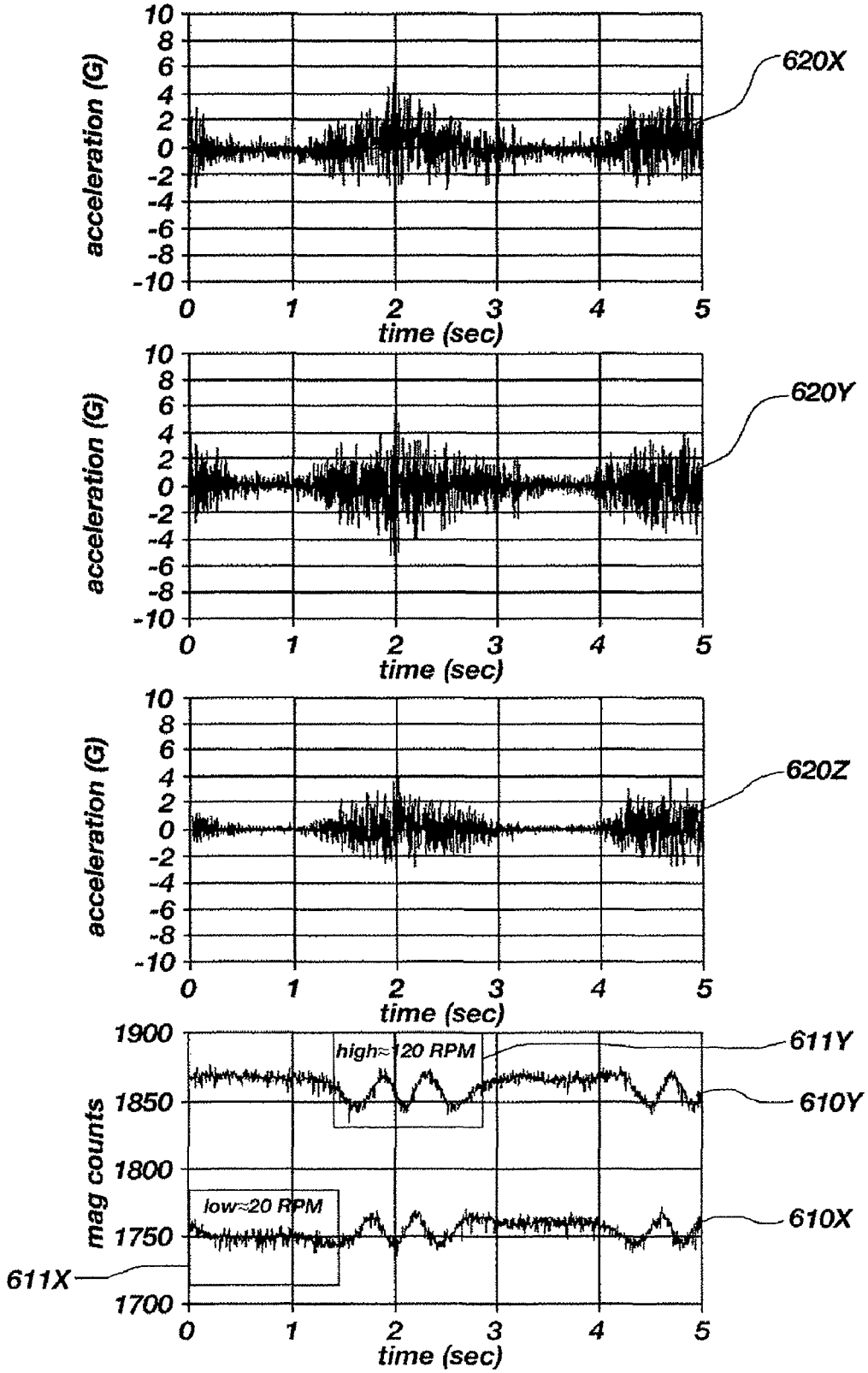
FIG. 10 illustrates examples of data sampled from accelerometer sensors and magnetometer sensors along three axes of a Cartesian coordinate system that is static with respect to the drill bit, but rotating with respect to a stationary observer.
Figure 11:
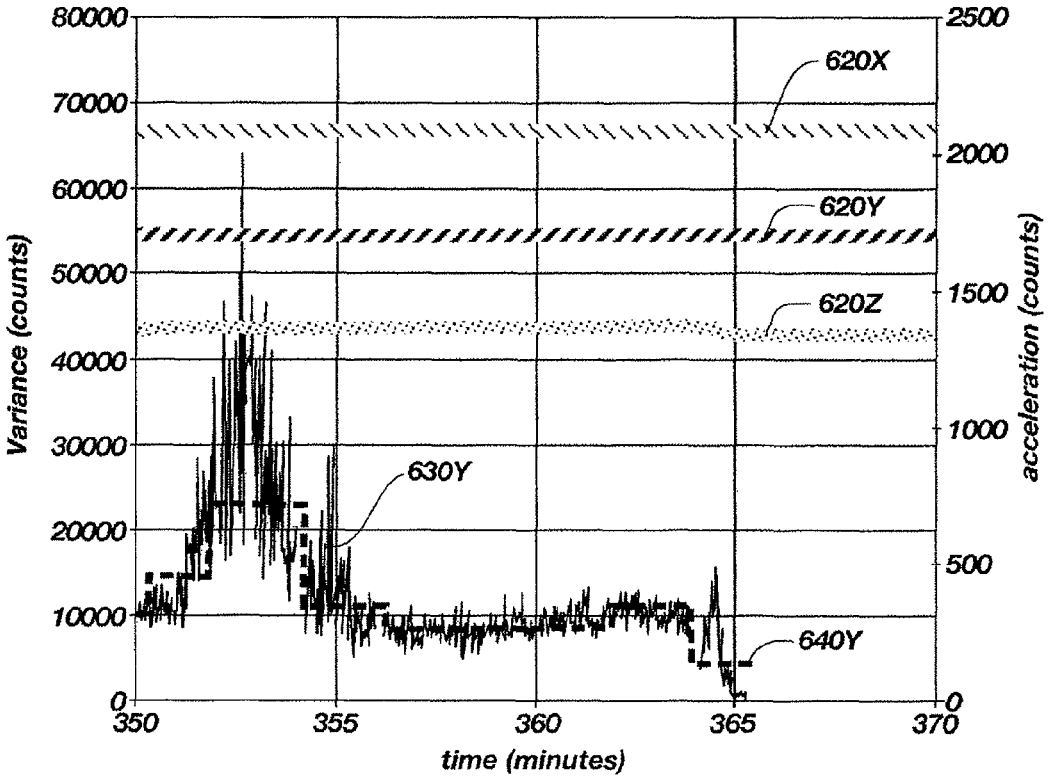
FIG. 11 illustrates examples of data sampled from accelerometer sensors, accelerometer data variances along a y-axis derived from analysis of the sampled data, and accelerometer adaptive thresholds along the y-axis derived from analysis of the sampled data.
Figure 12:
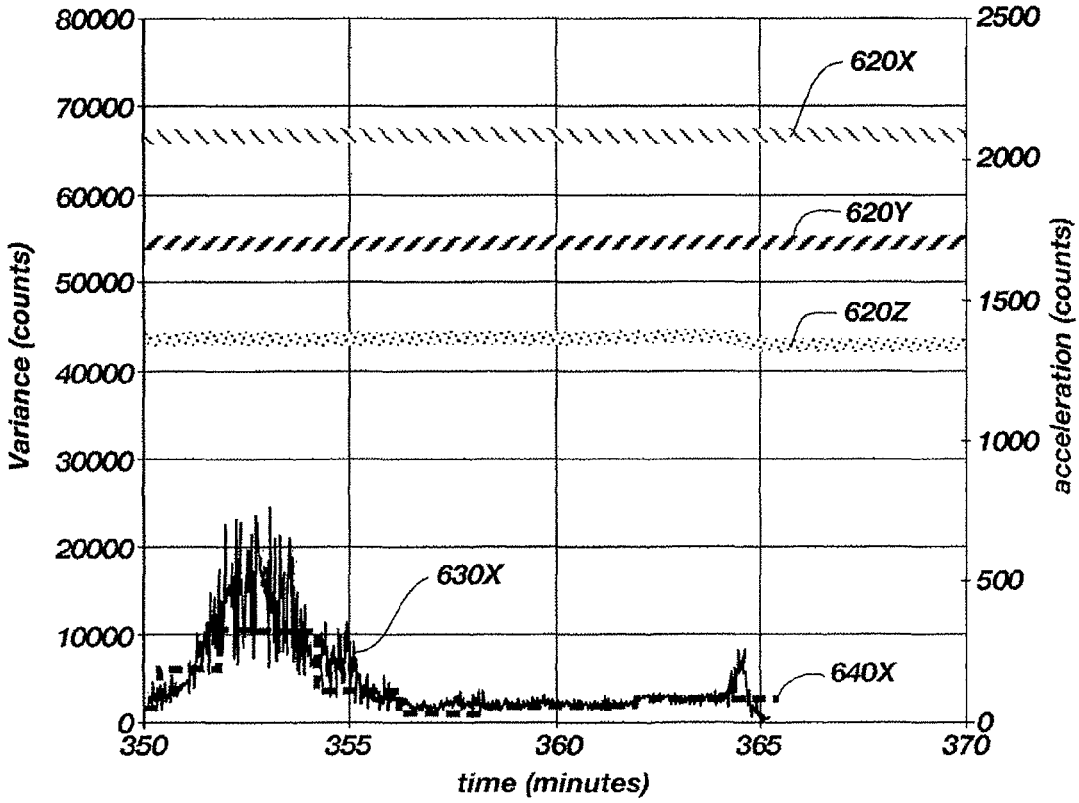
FIG. 12 illustrates examples of data sampled from accelerometer sensors, accelerometer data variances along an x-axis derived from analysis of the sampled data, and accelerometer adaptive thresholds along the x-axis derived from analysis of the sampled data.

FIGS. 10, 11, and 12 illustrate examples of types of data that may be collected by the data analysis module. FIG. 10 illustrates torsional oscillation. Initially, the magnetometer measurements 610Y and 610X illustrate a rotational speed of about 20 revolutions per minute (RPM) 611X, which may be indicative of the drill bit binding on some type of subterranean formation. The magnetometers then illustrate a large increase in rotational speed, to about 120 RPM 611Y, when the drill bit is freed from the binding force. This increase in rotation is also illustrated by the accelerometer measurements 620X, 620Y, and 620Z.

FIG. 11 illustrates waveforms (620X, 620Y, and 620Z) for data collected by the accelerometers. Waveform 630Y illustrates the variance calculated by the software for the Y accelerometer. Waveform 640Y illustrates the threshold value calculated by the software for the Y accelerometer. This Y threshold value may be used, alone or in combination with other threshold values, to determine if a data mode change should occur.

FIG. 12 illustrates waveforms (620X, 620Y, and 620Z) for the same data collected by the accelerometers as is shown in FIG. 11. FIG. 12 also shows waveform 630X, which illustrates the variance calculated by the software for the X accelerometer. Waveform 640X illustrates the threshold value calculated by the software for the X accelerometer. This X threshold value may be used, alone or in combination with other threshold values, to determine if a data mode change should occur.

As stated earlier, time-varying data such as that illustrated above with respect to FIGS. 9-12 may be analyzed for detection of specific events. These events may be used within the data analysis module to modify the behavior of the data analysis module. By way of example, and not limitation, the events may cause changes such as modifying power delivery to various elements within the data analysis module, modifying communications modes, and modifying data collection scenarios. Data collection scenarios may be modified, for example by modifying which sensors to activate or deactivate, the sampling frequency for those sensors, compression algorithms for collected data, modifications to the amount of data that is stored in memory on the data analysis module, changes to data deletion protocols, modification to additional triggering event analysis, and other suitable changes.

Trigger event analysis may be as straightforward as the threshold analysis described above. However, other more detailed analyses may be performed to develop triggers based on bit behavior such as bit dynamics analysis, formation analysis, and the like.

Many algorithms are available for data compression and pattern recognition. However, most of these algorithms are frequency based and require complex, powerful digital signal processing techniques. In a downhole drill bit environment, battery power, and the resulting processing power, may be limited. Therefore, lower power data compression and pattern recognition analysis may be useful. Other encoding algorithms may be utilized on time-varying data that are time based, rather than frequency based. These encoding algorithms may be used for data compression wherein only the resultant codes representing the time-varying waveform are stored, rather than the original samples. In addition, pattern recognition may be utilized on the resultant codes to recognize specific events. These specific events may be used, for example, for adaptive threshold triggering. Adaptive threshold triggering may be adapted for detection of specific types of known behaviors, such as, for example, bit whirl, bit bounce, bit wobble, bit walking, lateral vibration, and torsional oscillation. Adaptive threshold triggering may also be adapted for various levels of severity for these bit behaviors.

As an example, one such analysis technique includes time encoded signal processing and recognition (TESPAR), which has been conventionally used in speech recognition algorithms. Embodiments of the present invention have extended TESPAR analysis to recognize bit behaviors that may be of interest to record compressed data or to use as triggering events.

TESPAR analysis may be considered to be performed in three general processes. First, TESPAR parameters are extracted from a time-varying waveform. Next, the TESPAR parameters are encoded into alphabet symbols. Finally, the resultant encodings may be classified, or "recognized."

TESPAR analysis is based on the location of real and complex zeros in a time-varying waveform. Real zeros are represented by zero crossings of the waveform, whereas complex zeros may be approximated by the shape of the waveform between zero crossings.

Figure 13:
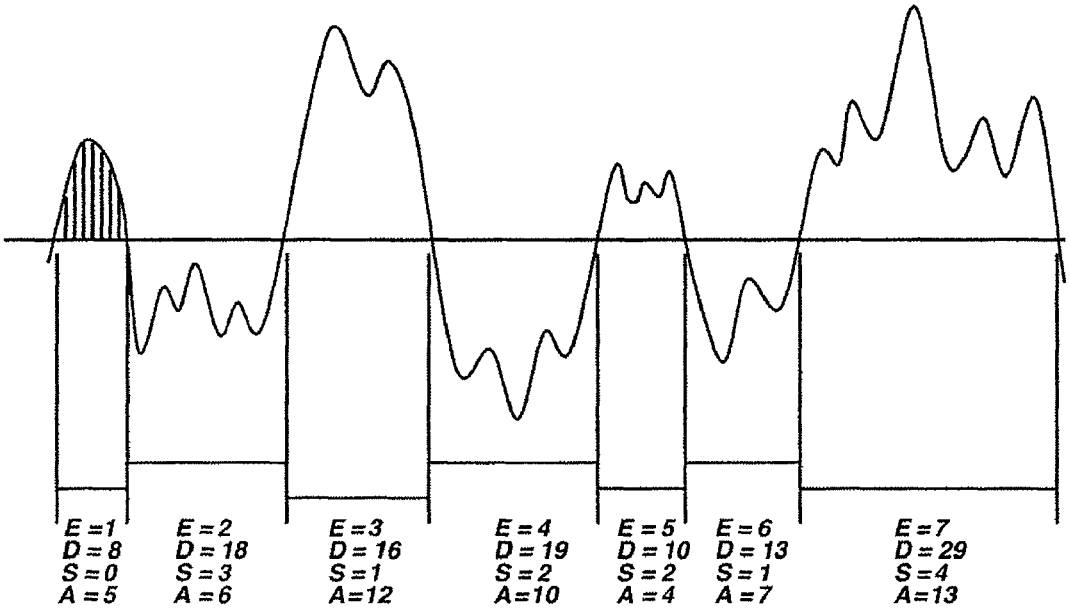
FIG. 13 illustrates a waveform and contemplated time encoded signal processing and recognition (TESPAR) encoding of the waveform in accordance with the invention.

FIG. 13 illustrates a waveform and TESPAR encoding of the waveform. The signal between each zero crossing of the waveform is termed an epoch. Seven epochs are shown in the waveform of FIG. 13. Another TESPAR parameter is the duration of an epoch. The duration is defined as the number of samples, based on the sample frequency collected for each epoch. To illustrate the duration, sample points are included in the first epoch showing eight samples for a duration of eight. An example sampling frequency that may be useful for accelerometer data and derivatives thereof, is about 100 Hz.

Another parameter defined for TESPAR analysis is the shape of the waveform in the epoch. The shape is defined as the number of positive minimas or the number of negative maximas in an epoch. Thus, the shape for the third epoch is defined as one because it has one minima for a waveform in the positive region. Similarly, the shape for the fourth epoch is defined as two because it has two maximas for the waveform in the negative region. A final parameter that may be defined for TESPAR analysis is the amplitude, which is defined as the amplitude of the largest peak within the epoch. For example, the seventh epoch has an amplitude of 13. FIG. 13 illustrates the parameters for each of the epochs of the waveform, wherein E=epoch, D=duration, S=shape, and A=amplitude.

With the waveform now extracted into TESPAR parameters, rather than storing samples of the waveform at every point, the waveform may be stored as sequential epochs and the parameters for each epoch. This represents a type of lossy data compression wherein significantly less data needs to be stored to adequately represent the waveform, but the waveform cannot be recreated with as much accuracy as when it was originally sampled.

The waveform may be further analyzed, and further compressed, by converting the TESPAR parameters to a symbol alphabet. FIG. 14 illustrates a possible TESPAR alphabet for use in encoding possible sampled data. The matrix of FIG. 14 shows the shape parameter as columns and the duration parameter as rows. In the TESPAR alphabet of FIG. 14, there are 28 unique symbols that may be used to represent the various matrix elements. Thus, an epoch with a duration of four and a shape of one would be represented by the alphabet symbol "4." Similarly, an epoch with a duration of 37 and a shape of three would be represented by the alphabet symbol "26."

While the alphabet illustrated in FIG. 14 may be used for a wide variety of time-varying waveforms, different alphabets may be defined and tailored for specific types of data collection, such as accelerometer and magnetometer readings useful for determining bit dynamics. Those of ordinary skill in the art will also recognize that the alphabet of FIG. 14 only goes up to a duration of 37 and a shape of 5. Thus, with this alphabet, it is assumed that for accurate TESPAR representation, the duration from one zero crossing to the next will be less than 37 samples and there will be no more than 5 minima or maxima within any given epoch.

Coding the epochs into alphabet symbols creates additional lossy compression as each epoch may be represented by its alphabet symbol and its amplitude. In some applications, the amplitude may not be needed and simply the alphabet symbol may be stored. Encoding the waveform of FIG. 13 yields a TESPAR symbol stream of 7-13-12-16-8-10-22 for the epochs 1 through 7.

Figure 15:
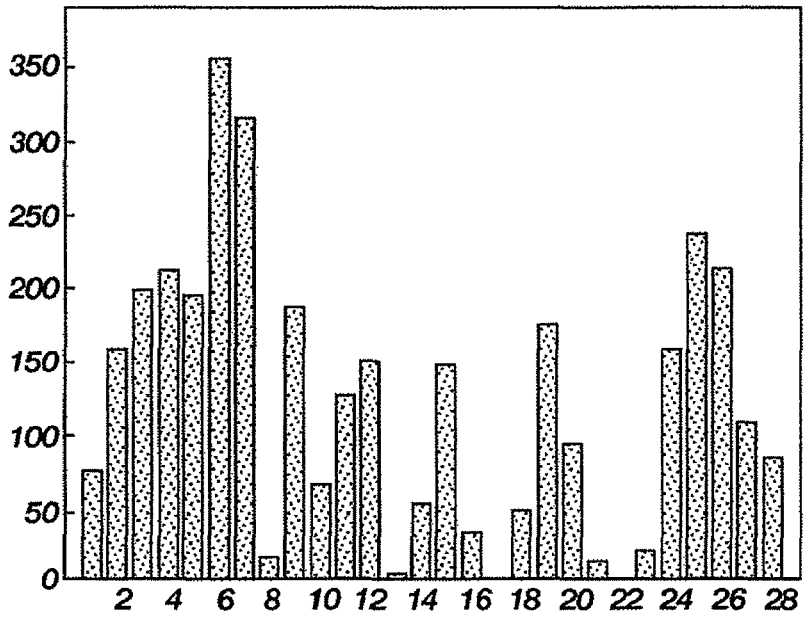
FIG. 15 is a histogram of TESPAR symbol occurrences for a given waveform.

For any given waveform, the waveform may be represented as a histogram indicating the number of occurrences of each TESPAR symbol across the duration of the TESPAR symbol stream. An example histogram is illustrated in FIG. 15. A histogram such as the one illustrated in FIG. 15 is often referred to as an S-matrix.

One of the strengths of TESPAR encoding is that it is easily adaptable to pattern recognition and has been conventionally applied to speech recognition to recognize speakers and specific words that are spoken by a variety of speakers. Embodiments of the present invention use pattern recognition to recognize specific behaviors of drill bit dynamics that may then be used as an adaptive threshold trigger. Some behaviors that may be recognized are whirl and stick/slip behaviors, as well as variations on these based on the severity of the behavior. Other example behaviors are the change in behavior of a drill bit based on how dull the cutters are or the type of formation that is being dialed, as well as specific energy determination defined as the energy exerted in drilling versus the volume of formation removed, or efficiency defined as the actual amount of work performed versus the minimum possible work performed.

Artificial neural networks may be trained to recognize specific patterns of S-matrices derived from TESPAR symbol streams. The neural networks are trained by processing existing waveforms that exhibit the pattern to be recognized. In other words, to recognize whirl, existing accelerometer data from a number of different bits or a number of different occurrences of whirl are encoded into a TESPAR symbol stream and used to train the neural network.

Figure 16:
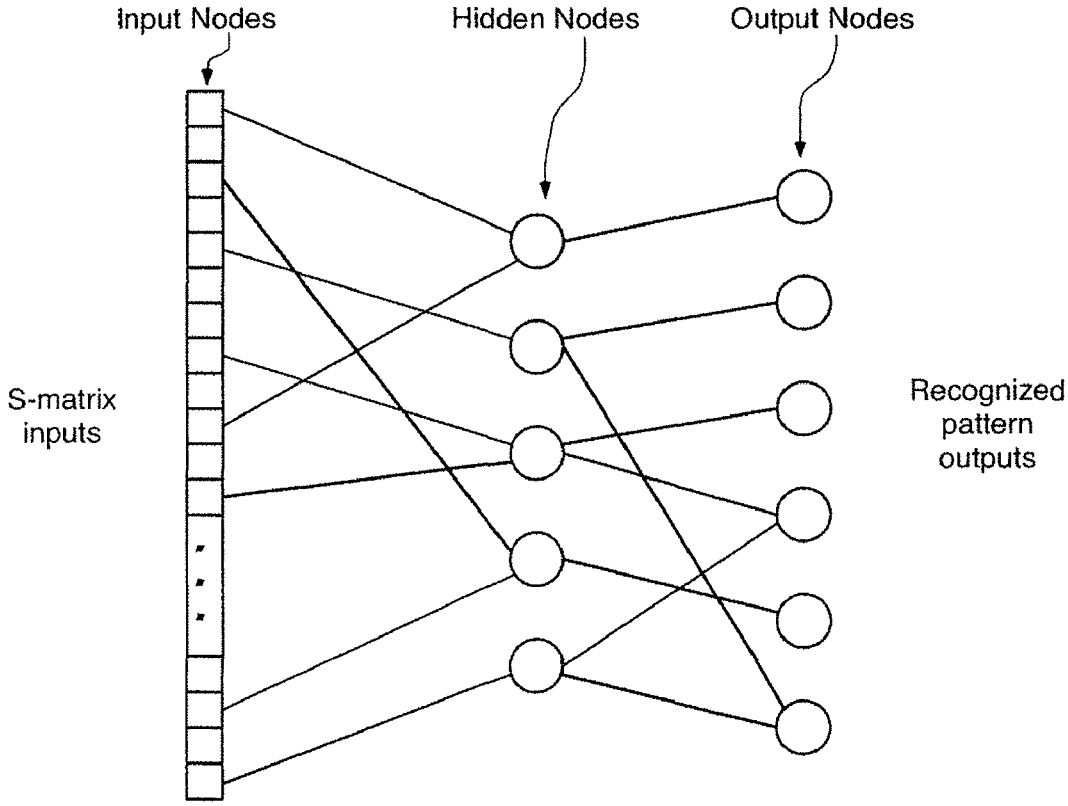
FIG. 16 illustrates a neural network configuration that may be used for pattern recognition of TESPAR encoded data in accordance with the invention.

A single neural network configuration is shown in FIG. 16. The input layer of the network includes a value for each of the TESPAR symbols indicating how many times each symbol occurs in the waveform. The network of FIG. 16 includes five nodes in the hidden layer of the network and six nodes in the output layer of the network indicating that six different patterns may be recognized. Of course, many configurations of hidden nodes and output nodes may be defined in the network and tailored to the types of behaviors to be recognized. As is understood by those of ordinary skill in the art of neural network analysis, the network uses the sample data sets as training information based on knowledge that the training set represents a desired behavior. The network is taught that a specific pattern on the input nodes should produce a specific pattern on the output nodes based on this prior knowledge. The more training data that is applied to the network, the more accurately the network is trained to recognize the specific behaviors and nuances of those behaviors. Training occurs offline (i.e., before use of the network as implemented in the data analysis module downhole) and the resultant trained network may then be loaded into the data analysis module in the drill bit.

Figure 17:
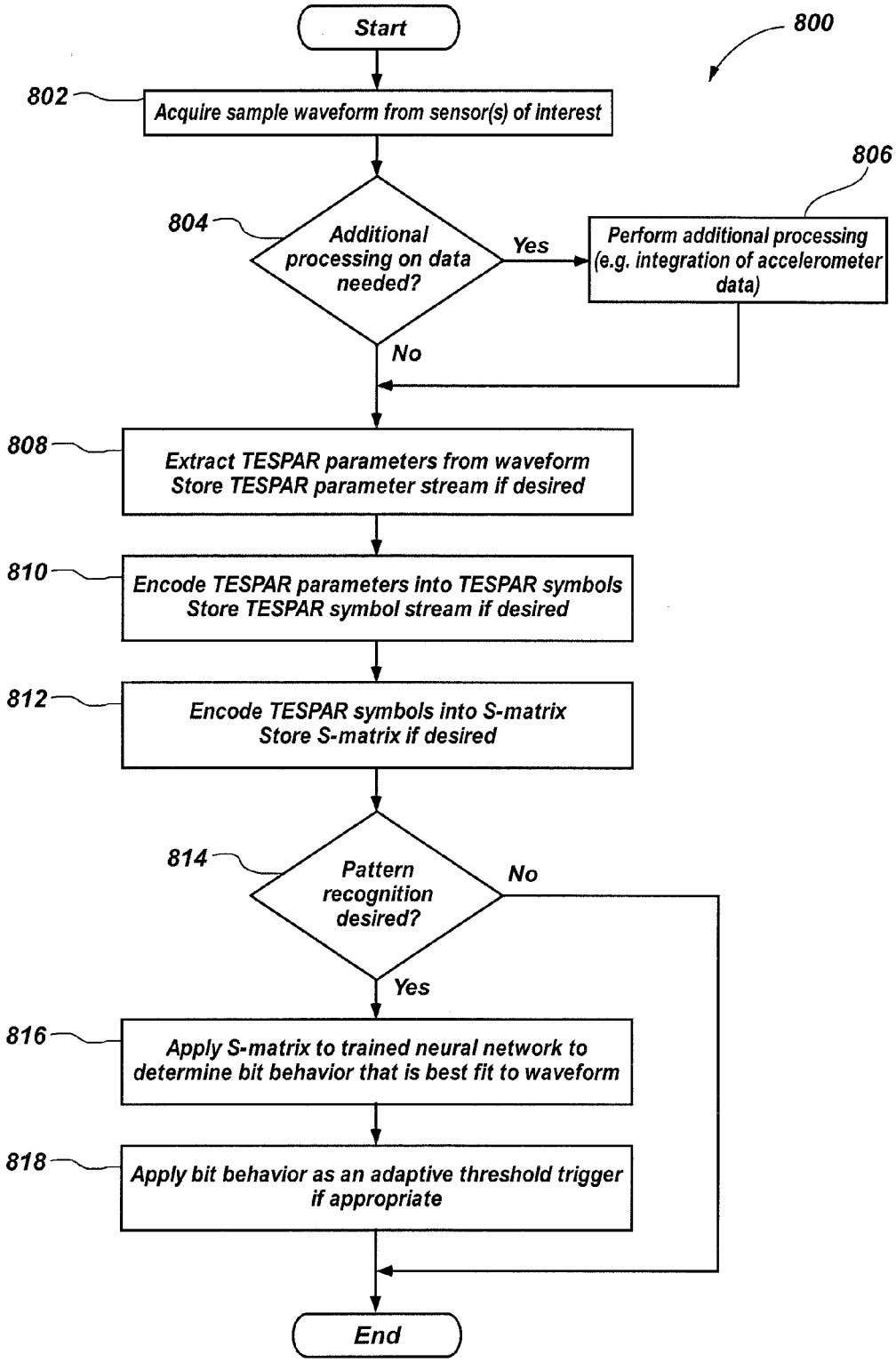
FIG. 17 is a flow diagram illustrating a contemplated software flow for using a TESPAR alphabet for encoding and pattern recognition of sampled data in accordance with the invention.

At this trained stage, the trained network may be used for pattern recognition. FIG. 17 is a flow diagram illustrating a possible software flow using TESPAR analysis for encoding, data compression, and pattern recognition of sampled data. The TESPAR process 800 begins by acquiring samples of data from sensor(s) of interest at process block 802. This data may include waveforms from sensors such as, for example, accelerometers, magnetometers, and the like. Decision block 804 tests to see if additional processing is needed on the data prior to encoding. If no additional processing is needed, flow continues at process block 808. If additional processing is needed, that processing is performed as indicated by process block 806. This additional processing may take on a variety of forms. For example, accelerometer data may be combined and converted from one coordinate system to another and data may be filtered. As another example, accelerometer data may be integrated to form velocity profiles or bit trajectories.

At process block 808, the desired time-varying waveform data is converted to TESPAR parameters as described above. If this level of data compression is desired, the TESPAR parameters may be stored for each epoch, creating a TESPAR parameter stream.

At process block 810, the TESPAR parameters are converted to TESPAR symbols using the appropriate alphabet as described above. If this level of data compression is desired, the TESPAR symbols may be stored for each epoch creating a TESPAR symbol stream.

At process block 812, the TESPAR symbol stream is converted to an S-matrix by determining the number of occurrences of each symbol within the stream, as is explained above. If this level of data compression is desired, the S-matrix may be stored.

Decision block 814 determines whether pattern recognition is desired. If not, the TESPAR analysis was used for data compression only, and the process exits. If pattern recognition is desired, the S-matrix is applied to the trained neural network to determine if any trained bit behavior is a match to the S-matrix, as is shown in process block 816.

At process block 818, if there is a match to a trained bit behavior, and that matched behavior is to be used as a triggering event, the triggering event may be used to modify behavior of the data analysis module.

Figure 18:
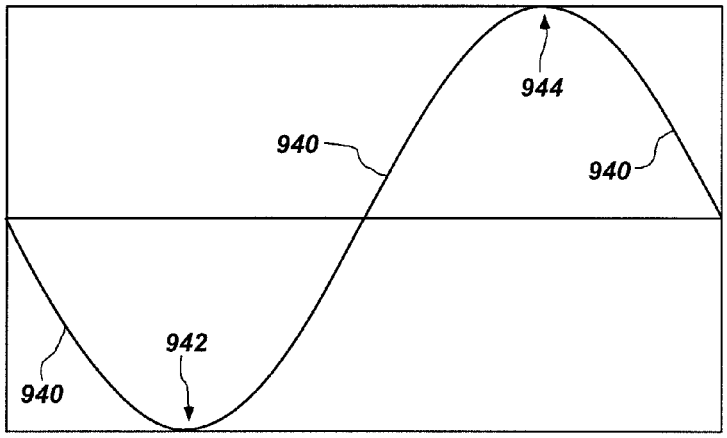
FIG. 18 is a representative diagram of a possible magnetometer signal.

Another analysis technique may include curve-fitting a piecewise cubic polynomial to the waveform of data collected by a sensor. By way of non-limiting example, embodiments of the present invention have extended curve-fitting analysis to filter out high-frequency components of a magnetometer waveform. The remaining low-frequency components of the magnetometer waveform may then be analyzed to recognize bit behaviors that may be of interest, to record compressed data, or to use as triggering events to modify behavior of the data analysis module. As illustrated in FIG. 18, a magnetometer's signal has the form of a sine wave 940 having a min point 942 and a max point 944. A cubic polynomial may be fitted between min point 942 and max point 944 and, therefore, a magnetometer's signal may be defined by a piecewise cubic polynomial.

A piecewise cubic polynomial curve-fitting analysis may be considered to be performed in three general processes. First, a numerical differentiation method, as known by one having ordinary skill in the art, may be utilized to approximate the first derivative of a sampled waveform. For example, the first derivative of a sampled waveform may be approximated using the equation:

$$f'(t)=(f(t+\Delta t)-f(t))/\Delta t$$

where f(t) represents the sampled waveform, Δt represents a change in t, and f'(t) represents the first derivative of the sampled waveform. Next, zeros of the first derivative may then be calculated to determine local minima and local maxima of the sampled waveform. Finally, between neighboring zeros, using the sampled waveform data, a cubic polynomial may be fitted to the sampled waveform resulting in a piecewise polynomial fit.

Figure 19A:
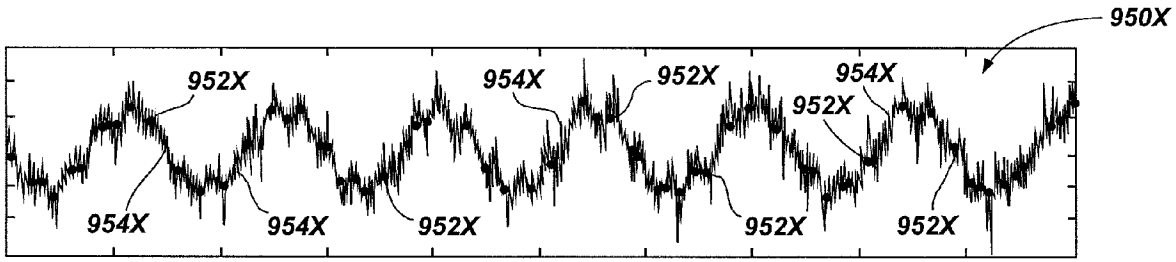
FIG. 19A illustrates examples of magnetometer sampled data along an x-axis and zeros calculated from a first derivative of the sampled data.
Figure 19B:
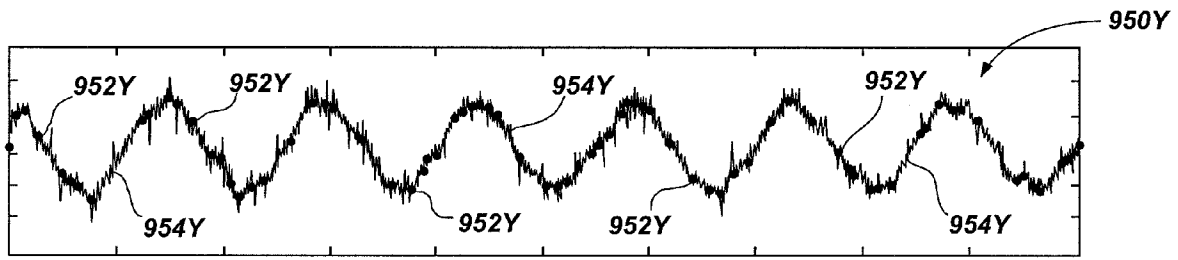
FIG. 19B illustrates examples of magnetometer sampled data along a y-axis and zeros calculated from a first derivative of the sampled data.
Figure 19C:
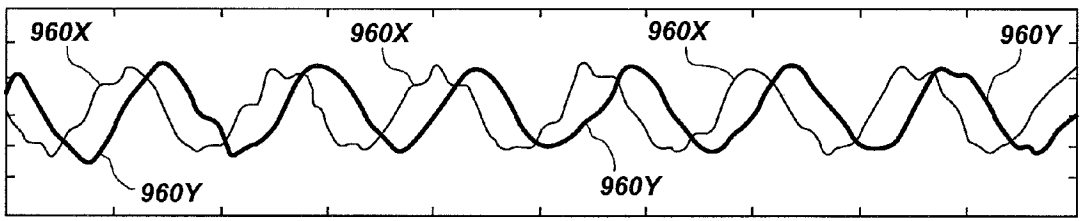
FIG. 19C illustrates examples of piecewise polynomial fitted data corresponding to the sampled data of FIGS. 19A and 19B.

FIG. 19A illustrates a magnetometer waveform 950X along an x-axis including raw data 954X and joint-points (i.e., where the first derivative and the second derivate of a waveform intersect) 952X. FIG. 19B illustrates a magnetometer waveform 950Y along a y-axis including raw data 954Y and joint-points 952Y. FIG. 19C illustrates a piecewise cubic polynomial curve 960X corresponding to magnetometer signal 950X and a piecewise cubic polynomial curve 960Y corresponding to magnetometer signal 950Y. It should be noted that, for clarity, only some of the joint-points 952X and 952Y are noted on FIGS. 19A and 19B.

As described above, zeros may be calculated from the first derivative of the corresponding waveform 954X/954Y. A piecewise cubic polynomial may then be fitted between neighboring zeros resulting in fitted curves 960X/960Y, as shown in FIG. 19C. The fitted piecewise cubic polynomial curves 960X/960Y are derived such that when they are fitted together they form a continuous and differentiable curve throughout their domain. Therefore, at joint-points 952X/952Y, adjoining curve segments must have equal magnitudes and equal slopes.

Figure 20:
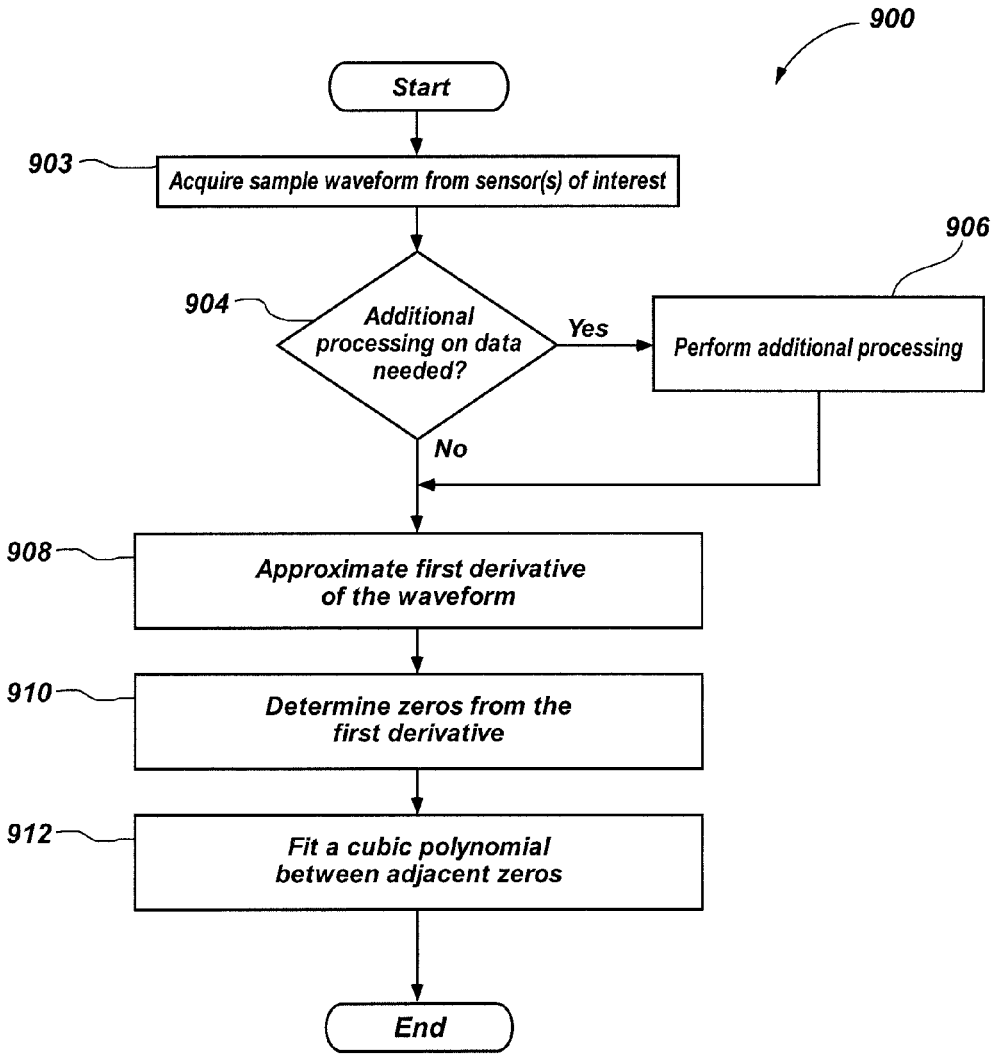
FIG. 20 is a flow diagram illustrating a contemplated software flow for using a piecewise polynomial fit to filter out the AC component of magnetometer sampled data in accordance with an embodiment of the invention.

FIG. 20 is a flow diagram illustrating one embodiment of a software flow using a piecewise polynomial fit to filter out the high-frequency components of a magnetometer waveform. The curve fitting process 900 begins by acquiring samples of data from sensor(s) of interest at process block 903. This data may include waveforms from sensors such as magnetometers. Decision block 904 tests to see if additional processing is needed on the data prior to encoding. If no additional processing is needed, flow continues at process block 908. If additional processing is needed, that processing is performed as indicated by process block 906, then flow continues at process block 908. This additional processing may take on a variety of forms. By way of non-limiting example, data compression techniques may be performed, other filtering operations may be performed, or adaptive triggers may be detected on data prior to the piecewise polynomial fit. At process block 908, the first derivative of the sampled waveform is approximated. At process block 910, zeros may be computed from the first derivative of the sampled waveform. At process block 912, a cubic polynomial may be fitted between adjacent zeros and, therefore, resulting in a piecewise cubic polynomial representing the sampled waveform.

Returning to the embodiment of FIG. 6, power controllers 316 are shown for gating the application of power from the power supply 310 to the memory 330, the accelerometers 340A, and the magnetometers 340M, as well as other possible sensors. Using these power controllers 316, software running on the processor 320 may manage a power control bus 326 including control signals for individually enabling a voltage signal 314 to each component connected to the power control bus 326. While the voltage signal 314 is shown in FIG. 6 as a single signal, it will be understood by those of ordinary skill in the art that different components may require different voltages. Thus, the voltage signal 314 may be a bus including the voltages necessary for powering the different components.

Figure 21A:
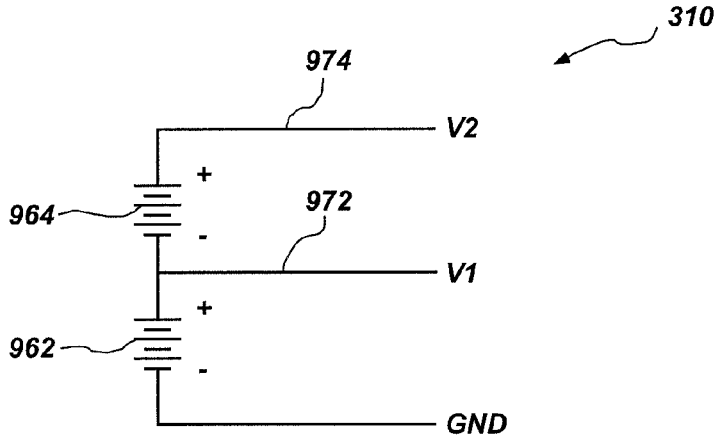
FIGS. 21A and 21B illustrate examples of power supply embodiments according to the present invention.
Figure 21B:
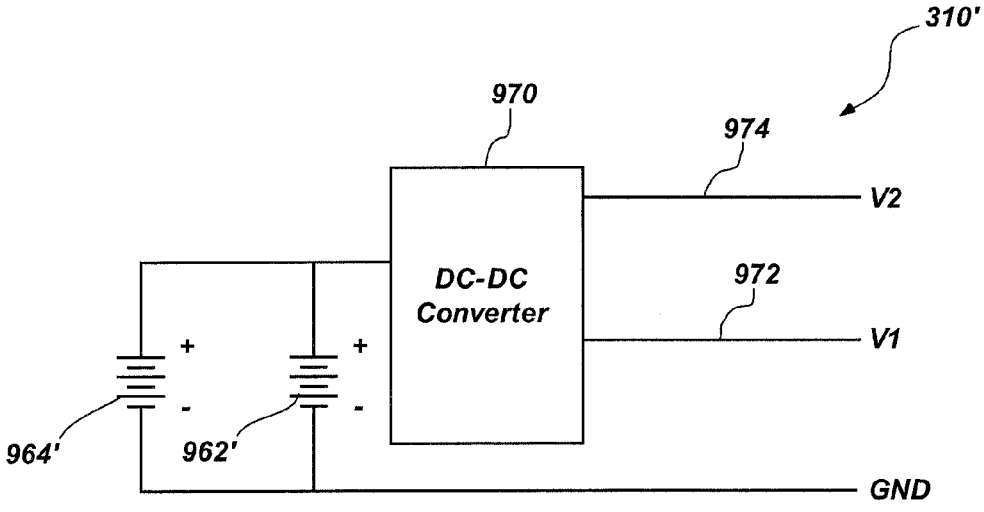

As non-limiting examples, FIGS. 21A and 21B illustrate embodiments of power supply 310 according to the present invention. As illustrated in FIG. 21A, one embodiment of the power supply 310 is configured to produce different voltage levels by combining multiple batteries in series. By way of non-limiting example, different voltage levels may be needed for accelerometers, magnetometers, processors, and different types of memories.

In FIG. 21A, a first battery 962 and a second battery 964 are connected in series to develop a first voltage 972 and second voltage 974. Of course, more batteries (not shown) may be connected in series to develop additional voltage levels (not shown) as needed. This power supply 310 is simple to implement and may be appropriate for many applications.

As another embodiment of the power supply 310', FIG. 21B illustrates a first battery 962' and a second battery 964' in parallel followed by a Direct Current to Direct Current (DC-DC) converter 970 to develop the first voltage 972 and the second voltage 974. The power supply 310' adds flexibility in the ability of the DC-DC converter 970 to produce the actual number and level of voltages needed by the various components of the system. Furthermore, a single battery, two batteries, or more may be combined in parallel to produce additional power in the forms of additional current and additional battery life. Also, by using the DC-DC converter 970, the batteries will generally last about the same amount of time, regardless of which of the first voltage 972 and second voltage 974 draws more power. Whereas, with the power supply 310 of FIG. 21A, if the second voltage 974 draws significant power, the second battery 964 may become depleted before the first battery 962.

While the present invention has been described herein with respect to certain embodiments, those of ordinary skill in the art will recognize and appreciate that it is not so limited. Rather, many additions, deletions, and modifications to the described embodiments may be made without departing from the scope of the invention as hereinafter claimed, and legal equivalents thereof. In addition, features from one embodiment may be combined with features of another embodiment while still being encompassed within the scope of the invention as contemplated by the inventors.

What is claimed is:

1. A drill bit for drilling a subterranean formation, comprising:

a bit bearing at least one cutting element and adapted for coupling to a drill string;

a chamber formed within a portion of the bit and configured for maintaining a pressure substantially near a surface atmospheric pressure while drilling the subterranean formation;

a first set of accelerometers disposed at a first location in the bit and comprising a first radial accelerometer and a second radial accelerometer;

a second set of accelerometers disposed at a second location in the bit and comprising a third radial accelerometer and a fourth radial accelerometer; and wherein the first, second, third, and fourth radial accelerometers are configured, positioned and oriented for sensing radial acceleration effects on the drill bit.

2. The drill bit for drilling a subterranean formation of claim 1, wherein the first radial accelerometer and the third radial accelerometer are configured for sensing accelerations of up to a magnitude and the second radial accelerometer and the fourth radial accelerometer are configured for sensing accelerations of up to a relatively smaller magnitude.

3. The drill bit for drilling a subterranean formation of claim 2, wherein the accelerations of up to a magnitude are accelerations up to 30 g and the accelerations of up to a relatively smaller magnitude are up to 5 g.

4. The drill bit for drilling a subterranean formation of claim 1, wherein the first set of accelerometers further comprises a first accelerometer configured, positioned and oriented for sensing tangential accelerations and the second set of accelerometers further comprises a second accelerometer configured, positioned and oriented for sensing tangential accelerations.

5. The drill bit for drilling a subterranean formation of claim 1, wherein the first set of accelerometers further comprises a first accelerometer configured, positioned and oriented for sensing axial accelerations and the second set of accelerometers further comprises a second accelerometer configured, positioned and oriented for sensing axial accelerations.

6. The drill bit for drilling a subterranean formation of claim 1, further comprising at least one magnetometer for sensing magnetic fields acting on the drill bit and further configured to be recalibrated under control of a processor operably coupled to the at least one magnetometer.

7. An apparatus for drilling a subterranean formation, comprising:

a drill bit bearing at least one cutting element and adapted for coupling to a drill string; and a data analysis module disposed in the drill bit and comprising:

a plurality of sensors for sensing at least one physical parameter, wherein the plurality of sensors comprises at least one magnetometer for sensing magnetic fields acting on the drill bit;

a memory for storing information comprising computer instructions configured for recalibrating the at least one magnetometer, and sensor data; and a processor for executing the computer instructions.

8. The apparatus of claim 7, wherein recalibrating the at least one magnetometer is performed in association with sampling a set of data from the at least one magnetometer.

9. The apparatus of claim 7, wherein the plurality of sensors includes:

a first set of accelerometers disposed at a first location in the drill bit and comprising a first radial accelerometer and a second radial accelerometer; and a second set of accelerometers disposed at a second location in the drill bit and comprising a third radial accelerometer and a fourth radial accelerometer;

wherein the first, second, third, and fourth radial accelerometers are configured, positioned and oriented for sensing radial acceleration effects on the drill bit.

10. The apparatus of claim 9, wherein the first radial accelerometer and the third radial accelerometer are configured for sensing accelerations of up to a magnitude and the second radial accelerometer and the fourth radial accelerometer are configured for sensing accelerations of up to a relatively smaller magnitude.

11. The apparatus of claim 9, wherein the accelerations of up to a magnitude are up to 30 g and the accelerations of up to a relatively smaller magnitude are up to 5 g.

12. The apparatus of claim 9, wherein the first set of accelerometers further comprises a first accelerometer configured, positioned and oriented for measuring tangential accelerations and the second set of accelerometers further comprises a second accelerometer configured, positioned and oriented for measuring tangential accelerations.

13. The apparatus of claim 9, wherein the first set of accelerometers further comprises a first accelerometer configured, positioned and oriented for measuring axial accelerations and the second set of accelerometers further comprises a second accelerometer configured, positioned and oriented for measuring axial accelerations.

14. An apparatus for drilling a subterranean formation, comprising:

a drill bit bearing at least one cutting element and adapted for coupling to a drill string; and a data analysis module disposed in the drill bit and comprising:

a plurality of sensors for sensing at least one physical parameter, wherein the plurality of sensors comprises at least one magnetometer for sensing magnetic fields acting on the drill bit;

a memory for storing information comprising computer instructions configured for recalibrating the at least one magnetometer, and sensor data;

a processor configured for executing the computer instructions; and a power source for supplying a first voltage for at least one of the plurality of sensors and supplying a second voltage for the processor.

15. The apparatus of claim 14, wherein the power source comprises at least two batteries connected in series to develop the first voltage and the second voltage.

16. The apparatus of claim 14, wherein the power source comprises:

at least one battery; and a Direct Current to Direct Current (DC-DC) converter operably coupled to the at least one battery and configured to develop the first voltage and the second voltage.

17. The apparatus of claim 14, wherein the power source is configured to supply at least one additional voltage different from the first voltage and the second voltage.

18. A method, comprising:

collecting sensor data at a sampling frequency by sampling at least one sensor disposed in a drill bit, wherein the at least one sensor is responsive to at least one physical parameter associated with a drill bit state; and filtering the collected sensor data to develop piecewise polynomial curves of the sensor data, wherein the filtering comprises:

approximating a first derivative of a sensor data waveform;

calculating a plurality of zeros from the first derivative of the sensor data waveform; and fitting a cubic polynomial between adjacent zeros calculated from the first derivative of the sensor data waveform resulting in a piecewise cubic polynomial.

19. The method of claim 18, wherein filtering the sensor data comprises filtering sensor data from at least one magnetometer.

20. The method of claim 18, wherein the plurality of zeros comprises a plurality of local minima and a plurality of local maxima of the first derivative of the sensor data waveform.

21. The method of claim 18, wherein approximating a first derivative of a sensor data waveform comprises approximating a first derivative of a sensor data waveform by a numerical differentiation method.

22. The method of claim 18, wherein filtering comprises filtering out at least some high-frequency components of the sensor data.

23. The method of claim 18, wherein the piecewise cubic polynomial is differentiable and continuous throughout its domain.

24. An apparatus for drilling a subterranean formation, comprising:

a drill bit bearing at least one cutting element and adapted for coupling to a drill string; and a data analysis module disposed in the drill bit and comprising:

at least one sensor configured for developing sensor data by sensing at least one physical parameter;

a memory; and a processor operably coupled to the memory and the at least one sensor, the processor configured for executing computer instructions, wherein the computer instructions are configured for:

filtering information derived from the sensor data in the drill bit to develop a set of piecewise polynomial curves of the sensor data, wherein the filtering comprises:

approximating a first derivative of a sensor data waveform;

calculating a plurality of zeros from the first derivative of the sensor data waveform; and fitting a cubic polynomial between adjacent zeros calculated from the first derivative of the sensor data waveform resulting in a piecewise cubic polynomial.

25. The apparatus of claim 24, wherein filtering information derived from the sensor data comprises filtering sensor data from at least one magnetometer.

26. The method of claim 24, wherein the plurality of zeros comprises a plurality of local minima and a plurality of local maxima of the first derivative of the sensor data waveform.

27. The method of claim 24, wherein approximating a first derivative of a sensor data waveform comprises approximating a first derivative of a sensor data waveform by a numerical differentiation method.

28. The method of claim 24, wherein filtering comprises filtering out an AC component of the sensor data.

29. The method of claim 24, wherein the piecewise cubic polynomial is differentiable and continuous throughout its domain.

* * * * *

UNITED STATES PATENT AND TRADEMARK OFFICE

CERTIFICATE OF CORRECTION

PATENT NO. : 8,100,196 B2
APPLICATION NO. : 12/367433
DATED : January 24, 2012
INVENTOR(S) : Paul E. Pastusek et al.

It is certified that error appears in the above-identified patent and that said Letters Patent is hereby corrected as shown below:

In the claims:

| | | | |
|---|---|---|---|
| CLAIM 26, | COLUMN 33, | LINE 8, | change “method” to --apparatus-- |
| CLAIM 27, | COLUMN 34, | LINE 1, | change “method” to --apparatus-- |
| CLAIM 28, | COLUMN 34, | LINE 5, | change “method” to --apparatus-- |
| CLAIM 29, | COLUMN 34, | LINE 7, | change “method” to --apparatus-- |

Signed and Sealed this
Sixth Day of May, 2014

Michelle K. Lee

Michelle K. Lee
*Deputy Director of the United States Patent and Trademark Office*